US006397762B1

(12) United States Patent
Goldberg et al.

(10) Patent No.: US 6,397,762 B1
(45) Date of Patent: Jun. 4, 2002

(54) WORK TABLE

(75) Inventors: Neil J. Goldberg, San Francisco; Imraan Aziz, Stanford; Vincent M. DiPalm, San Francisco, all of CA (US); Elliott W. Baum, Maryland Heights, MO (US); Lucian N. Chirea; Richard O. Berkowitz, both of St. Louis, MO (US)

(73) Assignee: Berco Industries, Inc., St. Louis, MO (US)

( * ) Notice: Subject to any disclaimer, the term of this patent is extended or adjusted under 35 U.S.C. 154(b) by 0 days.

(21) Appl. No.: 09/591,004

(22) Filed: Jun. 9, 2000

(51) Int. Cl.[7] ..... A47B 57/00
(52) U.S. Cl. ..... 108/50.02; 108/64
(58) Field of Search ..... 108/50.02, 50.01, 108/64; 312/223.6; 403/374.1, 374.5, 409.1, 110

(56) References Cited

U.S. PATENT DOCUMENTS

| | | | | |
|---|---|---|---|---|
| 2,661,988 A | | 12/1953 | Steene et al. | |
| 3,521,579 A | | 7/1970 | Stafford | |
| 4,163,867 A | | 8/1979 | Breidenbach | |
| 4,296,981 A | | 10/1981 | Hildebrandt et al. | |
| 4,559,877 A | | 12/1985 | Waibel | |
| 4,654,756 A | | 3/1987 | Wilson et al. | |
| 4,734,826 A | | 3/1988 | Wilson et al. | |
| 4,748,913 A | * | 6/1988 | Favaretto et al. | 108/64 X |
| 4,792,881 A | | 12/1988 | Wilson et al. | |
| 4,827,850 A | | 5/1989 | Diffrient | |
| 4,884,513 A | | 12/1989 | Newhouse et al. | |
| 5,078,055 A | * | 1/1992 | Bellini et al. | 108/64 |
| 5,083,512 A | | 1/1992 | Newhouse et al. | |
| 5,092,174 A | | 3/1992 | Reidemeister et al. | |
| 5,144,888 A | * | 9/1992 | Heine et al. | 108/64 |
| 5,144,896 A | | 9/1992 | Fortsch | |
| 5,154,126 A | | 10/1992 | Newhouse et al. | |
| 5,158,472 A | | 10/1992 | Juhlin | |
| 5,172,529 A | | 12/1992 | Van De Riet | |
| 5,231,562 A | * | 7/1993 | Pierce et al. | 108/50.02 X |
| 5,237,935 A | | 8/1993 | Newhouse et al. | |
| 5,252,086 A | | 10/1993 | Russell et al. | |
| 5,272,988 A | | 12/1993 | Kelley et al. | |
| 5,277,131 A | | 1/1994 | Fortsch | |
| 5,328,260 A | | 7/1994 | Beirise | |
| 5,337,657 A | | 8/1994 | Diffrient | |
| 5,339,747 A | | 8/1994 | Epps | |
| 5,383,318 A | | 1/1995 | Kelley et al. | |
| 5,403,232 A | | 4/1995 | Helm et al. | |
| 5,451,101 A | | 9/1995 | Ellison et al. | |
| 5,473,994 A | | 12/1995 | Foley et al. | |
| 5,483,900 A | | 1/1996 | Elzenbeck | |
| 5,511,349 A | | 4/1996 | Kelley et al. | |
| 5,530,435 A | | 6/1996 | Toms et al. | |
| 5,568,773 A | | 10/1996 | Hung | |
| 5,568,775 A | * | 10/1996 | Rizzi et al. | 108/64 |
| 5,606,920 A | | 3/1997 | Meyer et al. | |
| 5,607,317 A | | 3/1997 | King et al. | |

(List continued on next page.)

OTHER PUBLICATIONS

Bretford Manufacturing, Inc., product catalogue; no date.

*Primary Examiner*—Jose V. Chen
(74) *Attorney, Agent, or Firm*—Senniger, Powers, Leavitt & Roedel

(57) ABSTRACT

A table with cable trough adapted to be joined to one or more additional tables in generally end-to-end relation. The cable trough is movable between open and closed position at the rear of the table. An opening is provided in the table top such that when the trough is closed, cable receptacles are accessible through the opening for connecting equipment that is used on the table top. The rear comers of the table top are notched to provide space for a connector that will releasably retain adjacent tables in generally end-to-end relation.

39 Claims, 17 Drawing Sheets

U.S. PATENT DOCUMENTS

| | | | | |
|---|---|---|---|---|
| D378,731 | S | | 4/1997 | Kopish |
| 5,632,166 | A | | 5/1997 | Wiersma |
| 5,640,912 | A | | 6/1997 | Diffrient |
| 5,709,156 | A | | 1/1998 | Gevaert et al. |
| 5,718,179 | A | | 2/1998 | Johnson et al. |
| 5,765,932 | A | | 6/1998 | Domina et al. |
| 5,794,545 | A | | 8/1998 | McDaniel et al. |
| 5,878,673 | A | | 3/1999 | Kramer et al. |
| 5,886,295 | A | | 3/1999 | Carino et al. |
| 5,901,513 | A | | 5/1999 | Mollenkopf et al. |
| 5,907,285 | A | | 5/1999 | Toms et al. |
| 5,934,201 | A | | 8/1999 | Diffrient |
| 5,934,203 | A | | 8/1999 | Glass |
| 5,934,623 | A | | 8/1999 | Kopish |
| 5,943,966 | A | * | 8/1999 | Machado et al. ..... 108/64 |
| 5,947,628 | A | * | 9/1999 | Hansen ..... 108/64 X |
| 5,964,609 | A | | 10/1999 | Wilson et al. |
| 5,967,058 | A | * | 10/1999 | Ambrose et al. ..... 108/64 |
| 5,971,508 | A | | 10/1999 | Deimen et al. |
| 5,971,509 | A | | 10/1999 | Deimen et al. |
| 6,161,487 | A | * | 12/2000 | Chang ..... 108/64 X |
| 6,192,805 | B1 | * | 2/2001 | Saylor et al. ..... 108/50.02 X |
| 6,202,567 | B1 | * | 3/2001 | Funk et al. ..... 108/50.02 |

* cited by examiner

WORK TABLE

BACKGROUND OF THE INVENTION

The present invention relates to work tables for work rooms, training rooms and the like, and more particularly to work tables having electrical and communications management and the capability for interconnection with other work tables.

Tables and other furniture have been provided with cable troughs for housing cables used for power and communication of computers and other electronic devices. Tables of the type to which the present invention relates are used, for example, in training rooms where a number of people sit at each table and a computer is provided for each person. The computers each require connection to a source of electricity, and may also need connection to outside phone lines or other modem cable. One function of the cable troughs is to house the cables to prevent them from lying on the floor or hanging from the furniture thereby to make the workplace safer and to also make the workplace less cluttered in appearance and thus more aesthetically pleasing. Moreover, electrical codes may require the cables to be housed. Such furniture is typically set up for use at the work site. Setup generally requires running the cable in the trough and between adjacent pieces of furniture. Receptacles are provided in the table top for connecting office equipment, such as computers, modems and phones, to be operated on the table.

Access to the cable trough and the cables for connecting equipment has been provided in tables in positions where the equipment or cable installer can be at the rear of the furniture to obtain access. This typically results in the receptacles being located toward the rear of the work surface which may cause some inconvenience in connecting the work equipment. Further, when cables are strung between adjacent tables, the cables can have significant portions exposed offering opportunity for damage to the cables and injury to workers in addition to making the workplace appear cluttered and may even present regulatory issues. It is thus important to overcome these problems by providing a table and trough structure that allows for efficient access to the interior of the trough and the cables while keeping the trough out of the way of the table user.

Such furniture is oftentimes used in workplaces where it is not always possible or desirable to align end-to-end furniture in a straight line. Solutions to aligning furniture in other than a straight line have been provided but have presented problems. One solution includes constructing furniture that is not rectangular in shape, e.g., having at least one angled end edge. This results in the furniture pieces being positionable generally in only limited configurations when connected or the furniture not being adapted to also be positioned in a straight line. The problem with variability of configuration of joined tables is more pronounced with the presence of cable troughs since the troughs need to be on the same side of the furniture, e.g., the back side, to reduce the amount of exposed cable between furniture pieces and the amount of cable required. One solution to joined furniture configuration involves the use of rectangular furniture with wedge shaped fillers secured between the ends of the furniture to fix the furniture at various angles of configuration. Such wedges have typically been large, extending the full depth between the front and rear edges of the furniture. Further, they have been difficult to install. Their size also presents storage problems.

There is thus also a need for an improved work table with cable trough and work tables that can be easily set up at various angles relative to one another.

SUMMARY OF THE INVENTION

Among the several objects and features of the present invention may be noted the provision of a work table that allows easy access to receptacles for plugging in equipment; the provision of such a table that provides for easy access to the interior of a cable trough and stringing of cables in the cable trough; the provision of such a table that utilizes a single pedestal at each of opposite ends of the table with the pedestals being adapted for stringing cables therethrough and into the cable trough; the provision of such a table with openings in the pedestals in line with open ends of the trough that allow stringing of cables through the openings to extend between adjacent tables; the provision of a table that can be positioned in end-to-end relation with another table at various angles; the provision of such a table that provides for easy securement together at the various angles; and the provision of such a table that is easy to set up for use.

An aspect of the present invention involves a table for supporting electrically powered equipment for use by persons seated at the table. The table includes a table top having front and rear edges, opposite end edges, a top surface and an underside. A pedestal is positioned adjacent each end edge between the front and rear edges and are in supporting relation to the table top. A cable trough with an elongate open top providing access to an interior of the trough. The trough is mounted for movement relative to the table top between a closed position in which the open top is disposed adjacent to the underside of the table top so that the open top is substantially covered by the table top and an open position in which the open top is spaced further away from the underside of the table top so that the open top is at least partially uncovered from the table top and the interior is accessible thru the open top.

Another aspect of the present invention involves a table system including a table adapted for being selectively joined to at least one other table at a selected angular relationship. The table includes a table top for each table, each table top having front and rear edges, opposite end edges, a top surface and an underside. The table top has an intermediate edge portion extending between each end edge and one of the front and rear edges at an angle to the end edge, front edge and rear edge, the intermediate edge portions of adjacent joined tables define a notch. A first connector element associated with the table top at at least one intermediate edge of each table. A second connector element is provided and is adapted to interengage with the first connector elements of adjacent tables to releasably join two table tops together adjacent one of the end edges of each top at a preselected angular relationship.

A further aspect of the invention involves a connector for use in joining a pair of tables in end-to-end relation. The connector includes brackets each adapted to be secured to a respective one of the tables adjacent a comer thereof. A bridge is provided to extend between and releasably join the brackets together. The brackets each have at least one of a receiver and a latch element with a generally vertical axis. The bridge has at least one of the other of the receiver or latch element with a generally vertical axis. At least one of the latch element and receiver of the bracket is receivable in at least one of the other of the latch element and receiver in the bridge. At least one lock element cooperates with the brackets and the bridge to releasably retain the bridge connected to the brackets.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
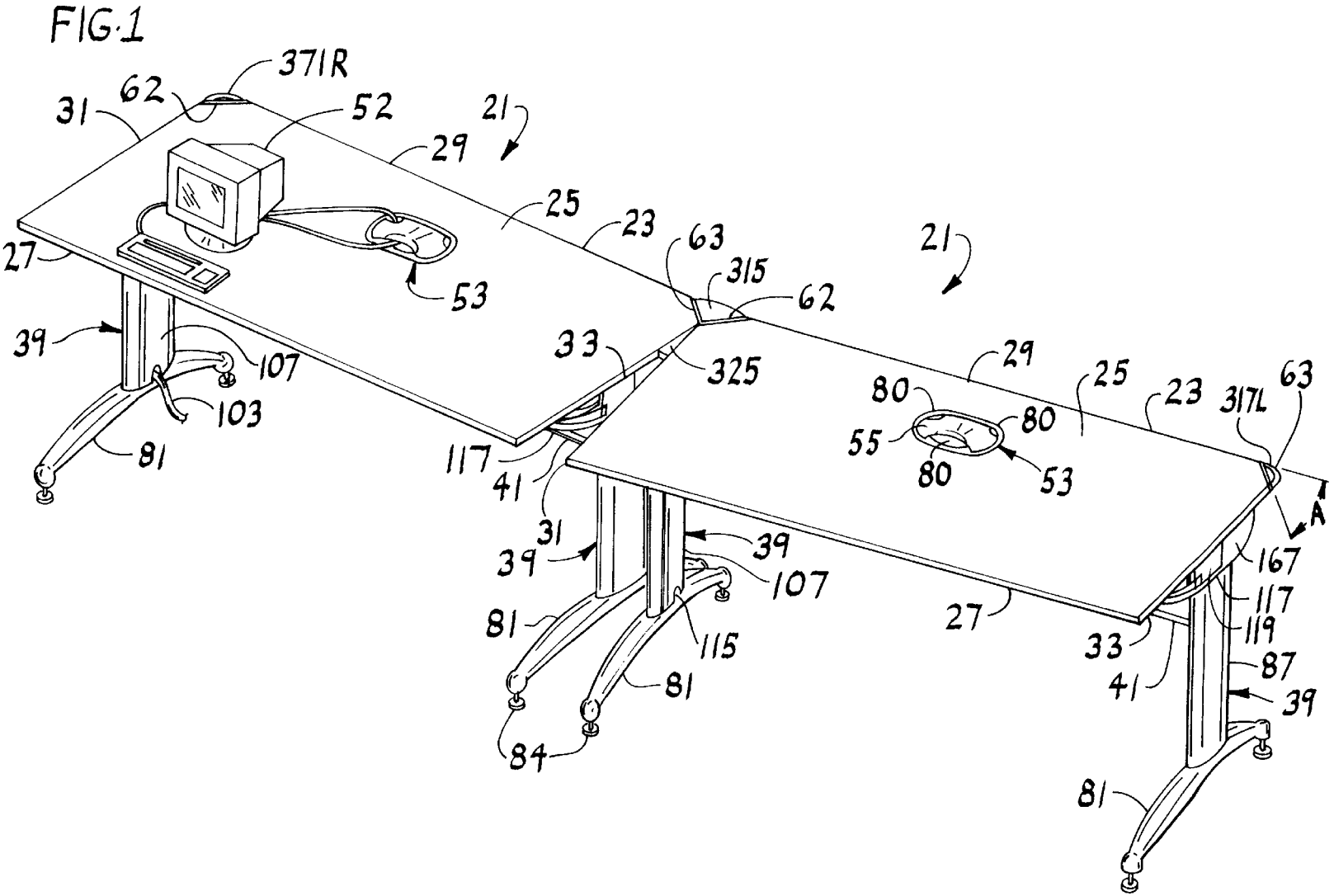
FIG. 1 is a perspective of a pair of tables joined together.
Figure 2:
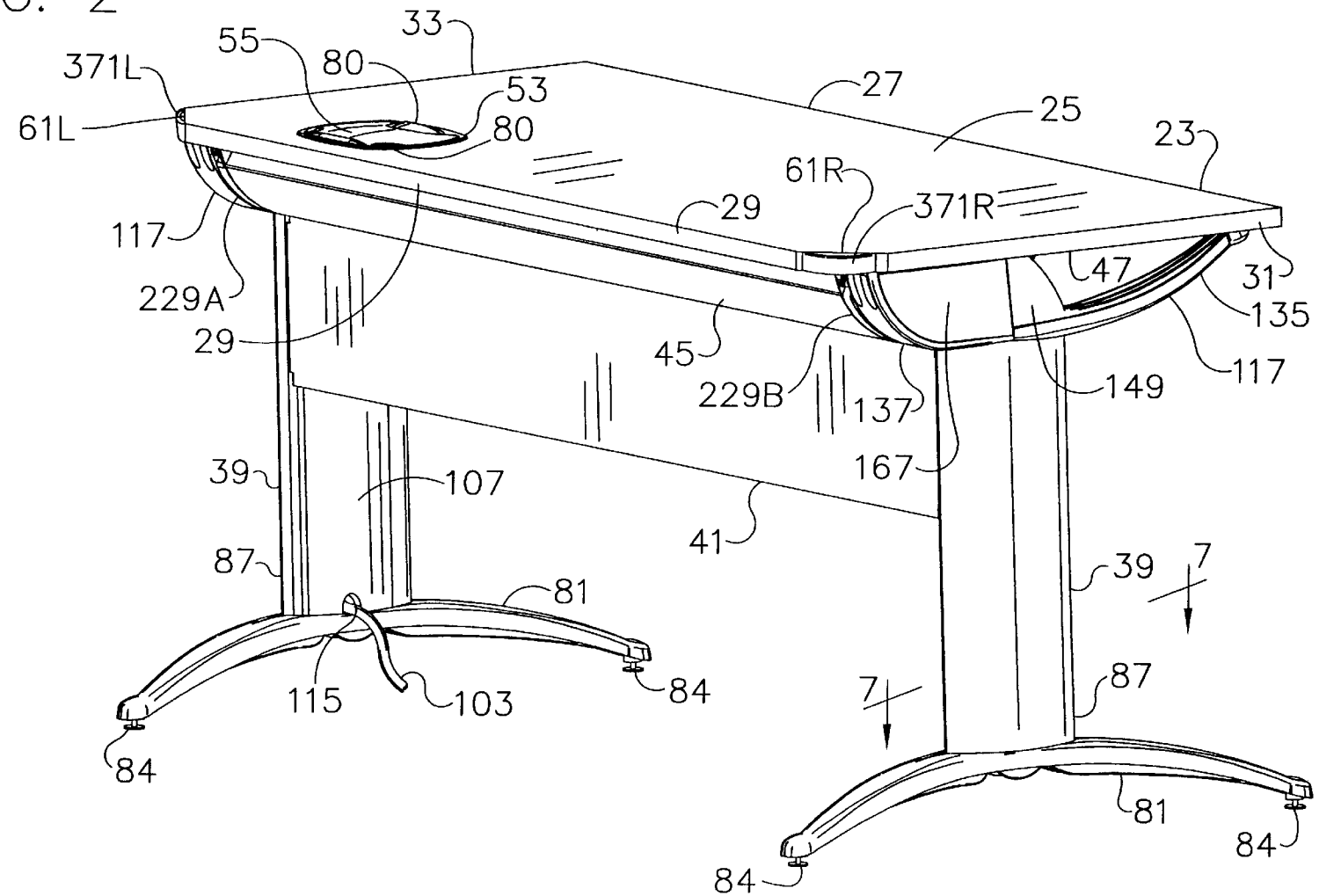
FIG. 2 is an enlarged perspective of a table viewed from the rear.
Figure 3:
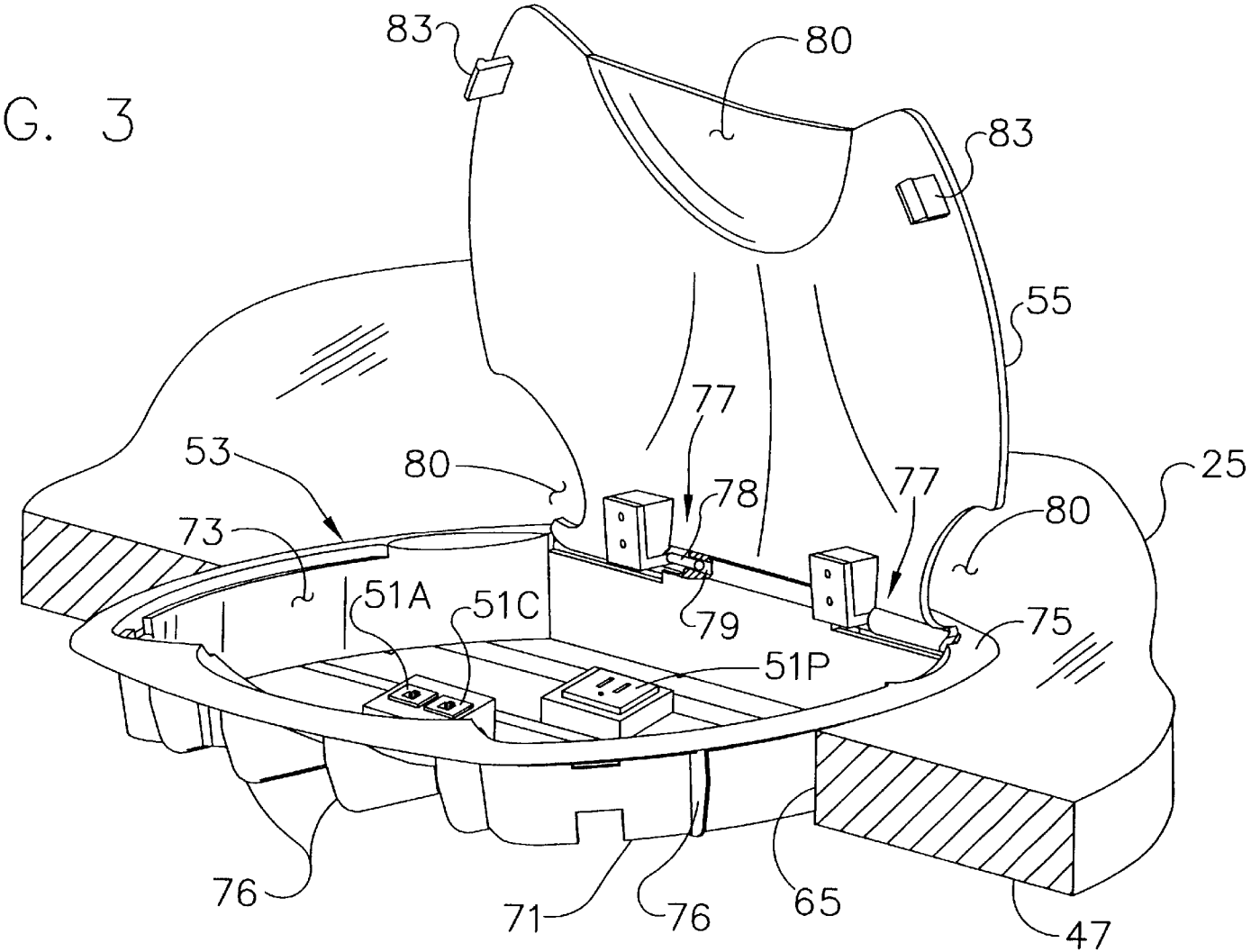
FIG. 3 is an enlarged fragmentary perspective of a grommet mounted in a table top.

A work table designated generally by the reference numeral 21, FIGS. 1 and 2. The table comprises a table top 23 with a work surface 25. The table top 23 has front and rear (back) edges 27, 29 respectively and opposite end edges 31, 33. Pedestals generally indicated at 39 are positioned adjacent the opposite ends 31, 33 and support the table top 23. A modesty panel 41 is secured to and extends between the pedestals 39. The panel 41 also functions as a stretcher to help brace the pedestals against lateral movement. A cable trough 45 is movably mounted on the underside 47 of the table top 23. Access to power and communication receptacles 51 within the cable trough 45 for connecting office equipment 52, like a computer, is provided through one or more grommets (generally indicated at 53) substantially closed by a cover 55. The receptacles 51 include a power receptacle 51P, communication receptacle 51C and computer receptacle 51A (FIG. 3).

The table top 23 can be of laminated construction with a particle board substrate and a high pressure laminate plastic top for the work surface 25. A pair of angled edge portions are provided to facilitate joining two tables together. In one embodiment, the back corners between the end edges 31, 33 and the rear edge 29 are beveled to form angled edge portions 62, 63 preferably at an angle A in the range of about 15° through about 60° and preferably between about 30° through about 45° relative to the rear edge. The edges 62, 63 of adjacent tables form a notch when the tables are in end-to-end relation.

An opening 65 extends through the table top 23 for mounting of the grommet 53 therein. Preferably, the grommet 53 and opening 65 are positioned behind the centerline of the table (relative to the front edge 27). The grommet 53 can be positioned at any longitudinal position between pedestals 39. More than one grommet 53 and opening 65 may be provided in a table if desired.

The grommet 53 (FIG. 3) includes a wall 71 with an outer perimeter sized and shaped to be received in the opening 65 and an inner perimeter that defines a thru opening 73. A lip 75 projects laterally outwardly from the wall 71 at the top thereof to overlie and engage the work surface 25 outwardly of the opening 65. The grommet 53 can be retained in the opening 65 in any suitable manner, e.g., by friction fit with outwardly projecting ribs on the wall 71, snap lock or with adhesive. In the illustrated embodiment, a plurality of ribs 76 extend outwardly from the wall 71. The ribs 76 engage the surface of the table top 23 defining the opening 65 to retain the grommet 53 mounted in the table top 25.

The cover 55 is associated with the grommet in a manner to allow the opening 73 to be selectively open or closed and when open, to provide access to the receptacles 51. The cover 55 is hinged to the grommet by a pair of hinges 77 each comprising a hinge pin 78 that is rotatably received in an aperture 79. The grommet 53 and cover 55 may be of molded plastic or die cast metal such as aluminum alloy. The grommet is preferably injected molded plastic and the cover is preferably die cast metal alloy. The cover may also be anodized or powder coated for decoration. One or more access openings 80 can be provided between the cover 55 and grommet 53 when the cover is closed for passage of cables from the equipment used on the table to the receptacles while substantially closing the opening 73. The cover 55 is provided with snap acting latches 83 to releasably retain the cover in the closed position. The openings 80 also provides access for fingers to the bottom side of the cover 55 for opening the cover.

Figure 4:
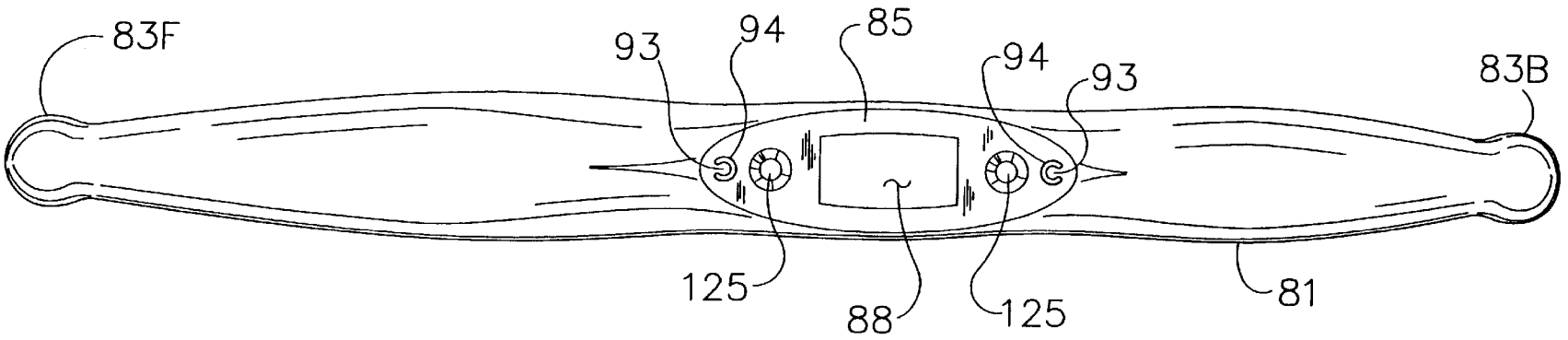
FIG. 4 is a plan view of a pedestal base.
Figure 7:
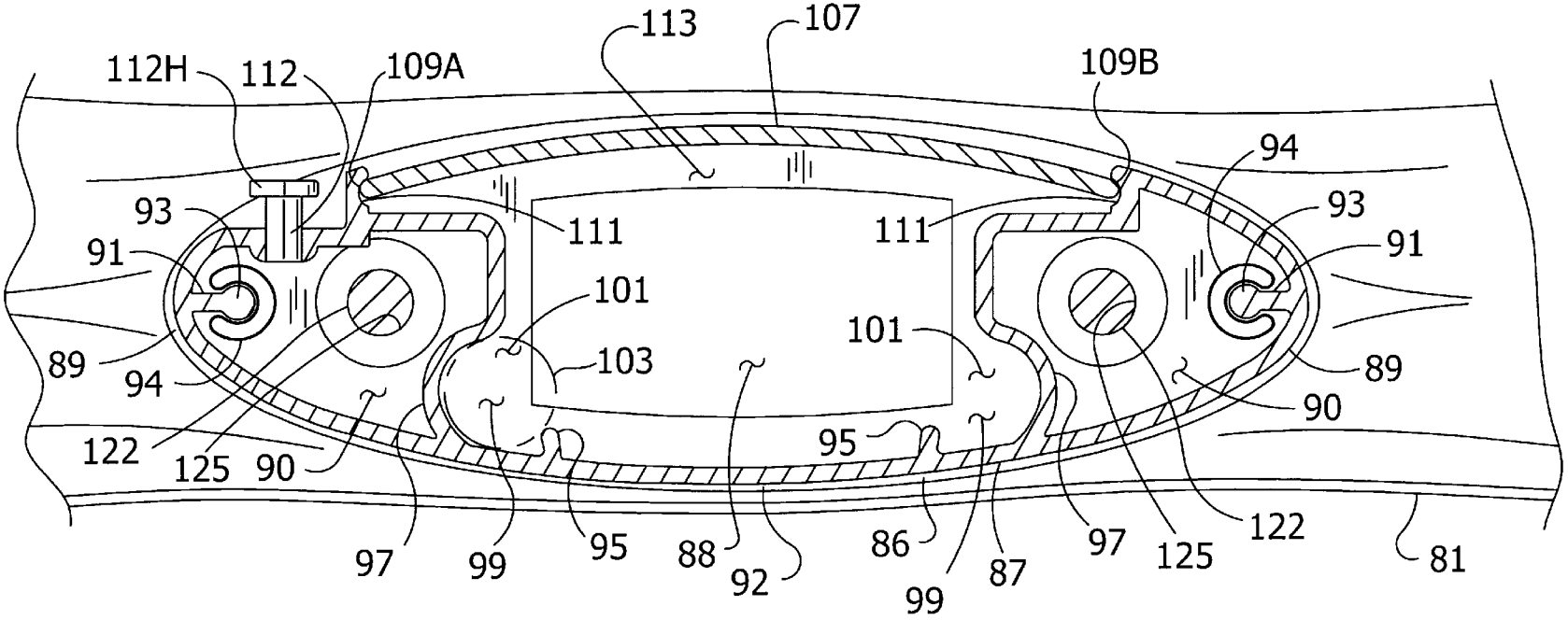
FIG. 7 is an enlarged fragmentary section view of a pedestal riser taken along the line 7—7, FIG. 2.

A pedestal 39 includes a base 81 for resting on a floor, FIGS. 2 and 4. The base 81 has two spaced apart rest pads 83F, 83B for the front and back of the base respectively. The longitudinal axis of a base extends generally perpendicular to the front and back edges 27, 29. The base 81 has a length slightly less than the depth (distance between the front and back edges 27, 29) of the table top 23. The bottom edge of the base 81 is arcuate (concave) between the pads 83F, 83B to avoid contact with the floor except at the pads for stability on uneven floors. Adjustable feet 84 are also provided at the pads 83F, 83B in the illustrated embodiment. Casters or other suitable supports (not shown) may be provided in place of the feet. The base 81 is also provided with a socket 85 recessed in the top surface and intermediate the pads 83F, 83B. The socket is upwardly opening and is adapted to receive the lower end of an upstanding riser 87 therein (FIG. 7). A through passage 88 extends between the socket and the bottom side of the base 81. The base is preferably made of metal, such as aluminum alloy and is also preferably made by a die casting process. The bases may be anodized or powder coated for decoration.

The riser 87 includes a channel member 86 that includes two longitudinally extending tubular edge sections 89 forming longitudinally extending passages 90 that are connected by a curved web 92 (FIG. 7). At the outermost portion of each passage 90, an inwardly extending key 91 is provided that is sized and shaped to fit into a respective keyway 93 in an upstanding post 94 formed in the base 81 in the bottom of the socket 85. The keys 91 positively align the riser 87 with the base 81 for assembly. The riser 87 also includes a pair of longitudinally extending transversely curved ribs 95 spaced from curved wall sections 97. Each wall section 97 and adjacent rib 95 defines a recess 99 extending substantially the full height of the riser 87. Each recess 99 has an opening 101 between the end of the rib 95 and the wall section 97 slightly smaller than the diameter of a cable so the cable 103 (shown in phantom), such as an armored electrical power cable, can be snapped into and releasably retained in the recess 99. The opposed wall sections 97 define a channel 113 on the interior of the riser 87 permitting access to the recesses 99 and cables within the riser.

The riser 87 includes a closure panel 107 to cover the channel 113. The panel 107 has two longitudinal side edges 109A, 109B. The panel is resiliently deformable and is outwardly curved in transverse cross section when mounted on a riser. Each edge 109A, 109B is received in a respective longitudinally extending groove 111 in the riser. The panel is thus releasably retained on the riser and closes the channel 113. The panel 107 is provided with a notch 115 (FIG. 2) at the bottom edge for exit of the cable from the channel 113 if desired. Also, the notch 115 may be used to facilitate removal of the panel 107 by insertion of a finger or the like to pull the panel outwardly and thereby deforming the panel to release the edges 109A, 109B from the grooves 111. The panel 107, like the riser 87 is preferably formed by extrusion providing a uniform transverse shape along the length thereof and is preferably made of a resiliently deformable plastic, e.g., PVC. The notch 115 may be formed, e.g., by machining, in the panel 107 after the panel is formed by extrusion.

Figure 11:
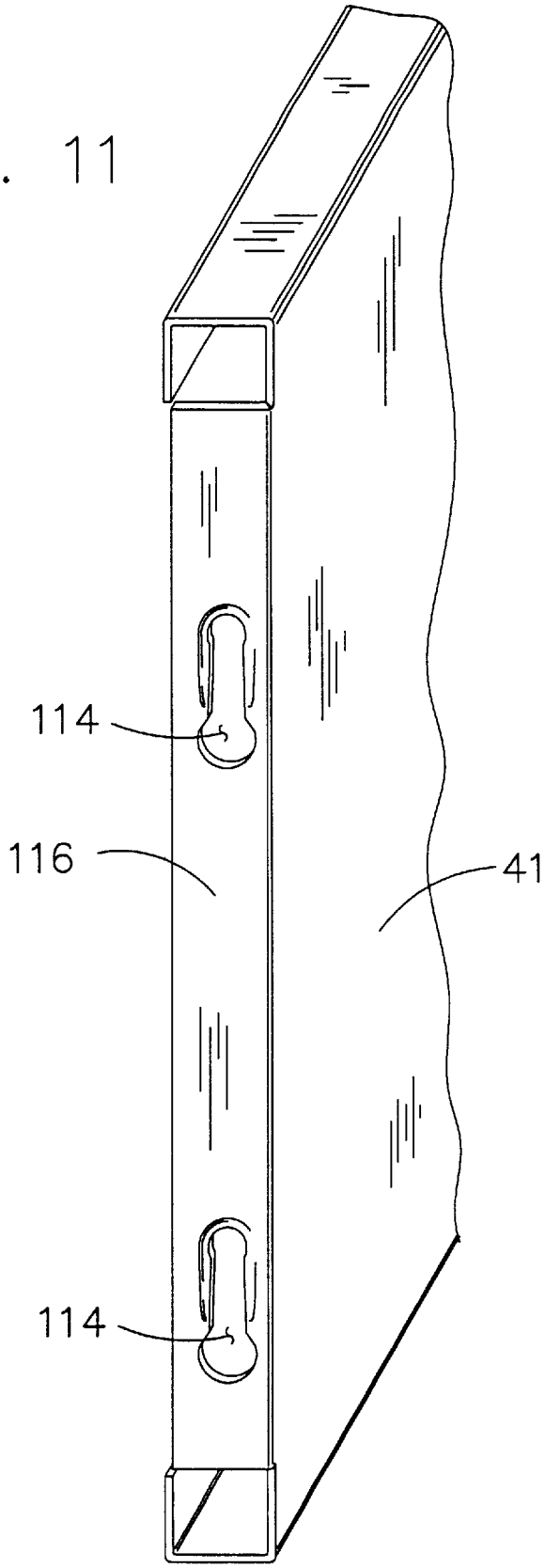
FIG. 11 is a fragmentary perspective of a modesty panel.

Each riser 87 is provided with two or more headed studs 112 (FIG. 7) secured thereto and spaced along the height of the riser. The studs 112 are secured to the riser, e.g., by press fitting, after the riser is formed and extend inboard from the riser generally toward the center of the table. The modesty panel 41 (FIG. 11) has keyhole slots 114 through end flanges 116 so that the modesty panel may be mounted to the riser by inserting the studs into the slots 114 to retain the flanges between the heads 112H of the studs and the riser.

Figure 5:
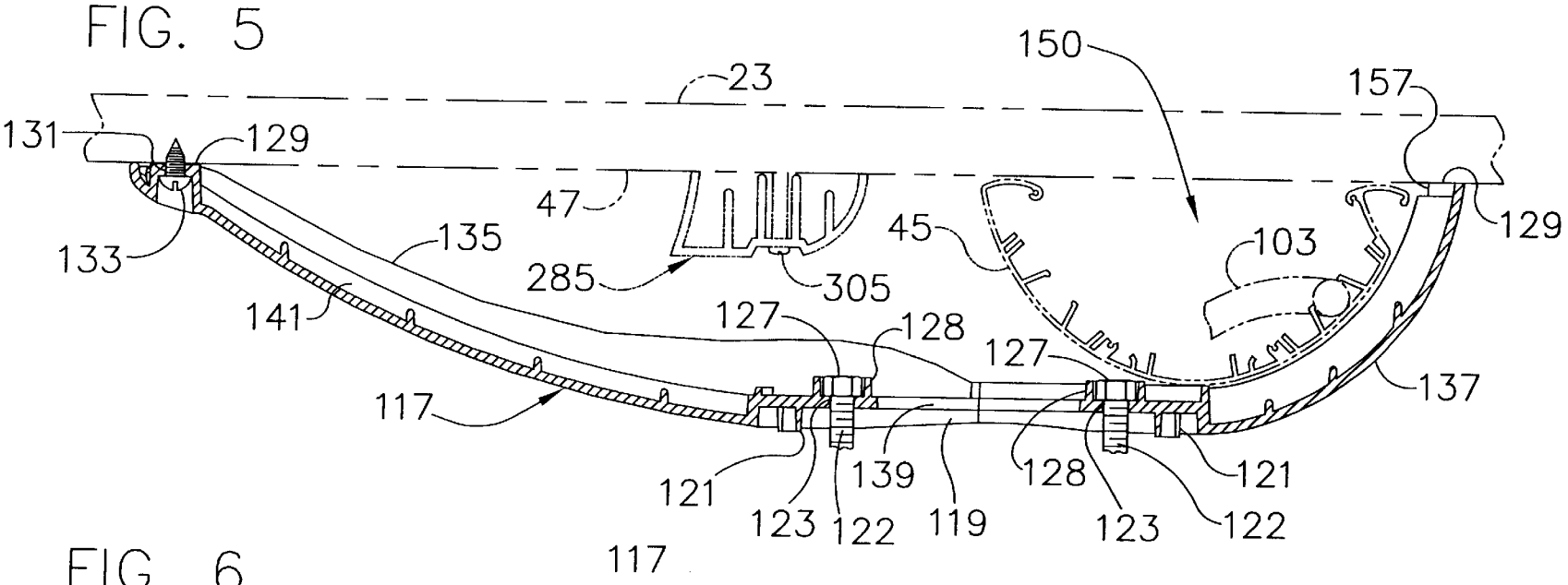
FIG. 5 is a side view of a pedestal spider showing a table top, cable trough and brace in phantom and the spider in section.
Figure 6:
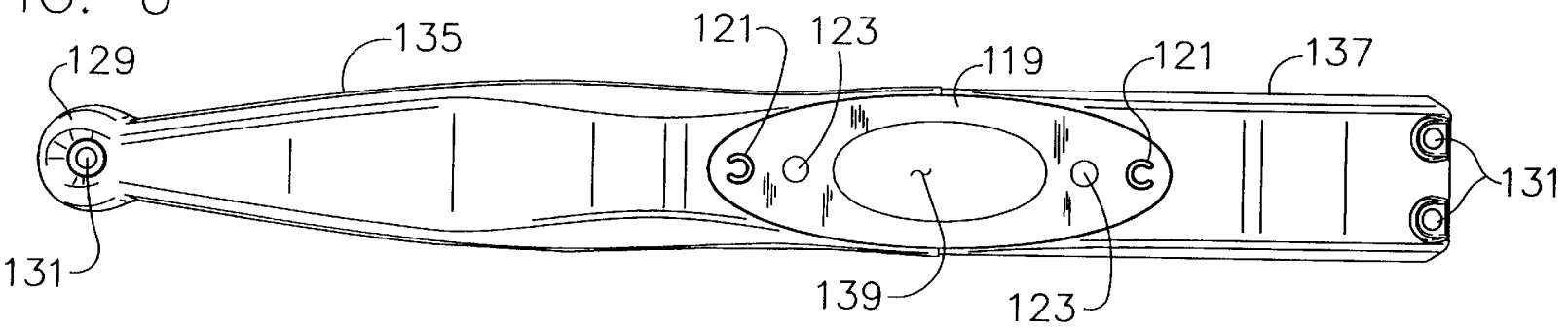
FIG. 6 is a bottom view of a spider.

A spider 117 (FIGS. 5 and 6) is provided to form the top of a pedestal 39. The spider includes a downwardly opening socket 119 sized and shaped to receive therein the top of the riser 87 and is preferably provided with a pair of keyway posts 121 like the keyway posts 94. The spider 117 is secured to the top of the riser 87. As best seen in FIGS. 5 and 7, a pair of threaded rods 122 extend thru openings 123, 125 in the spider 117 and the base 81 respectively. The openings 125 may be taper countersunk on the top to facilitate insertion of the rods 122. The rods 122 are retained in place with hex nuts 127 with a pair of the nuts each being received in a hex shaped pocket 128 in the spider 117 to prevent their turning when tightening the nuts on the bottom of the threaded rods in the base. The spider 117 includes a pair of upwardly facing pads 129 with through openings 131. The table top 23 rests on the pads 129 of a pair of pedestals and is secured thereto by mechanical fasteners such as screws 133 extending through the openings 131.

Figure 8:
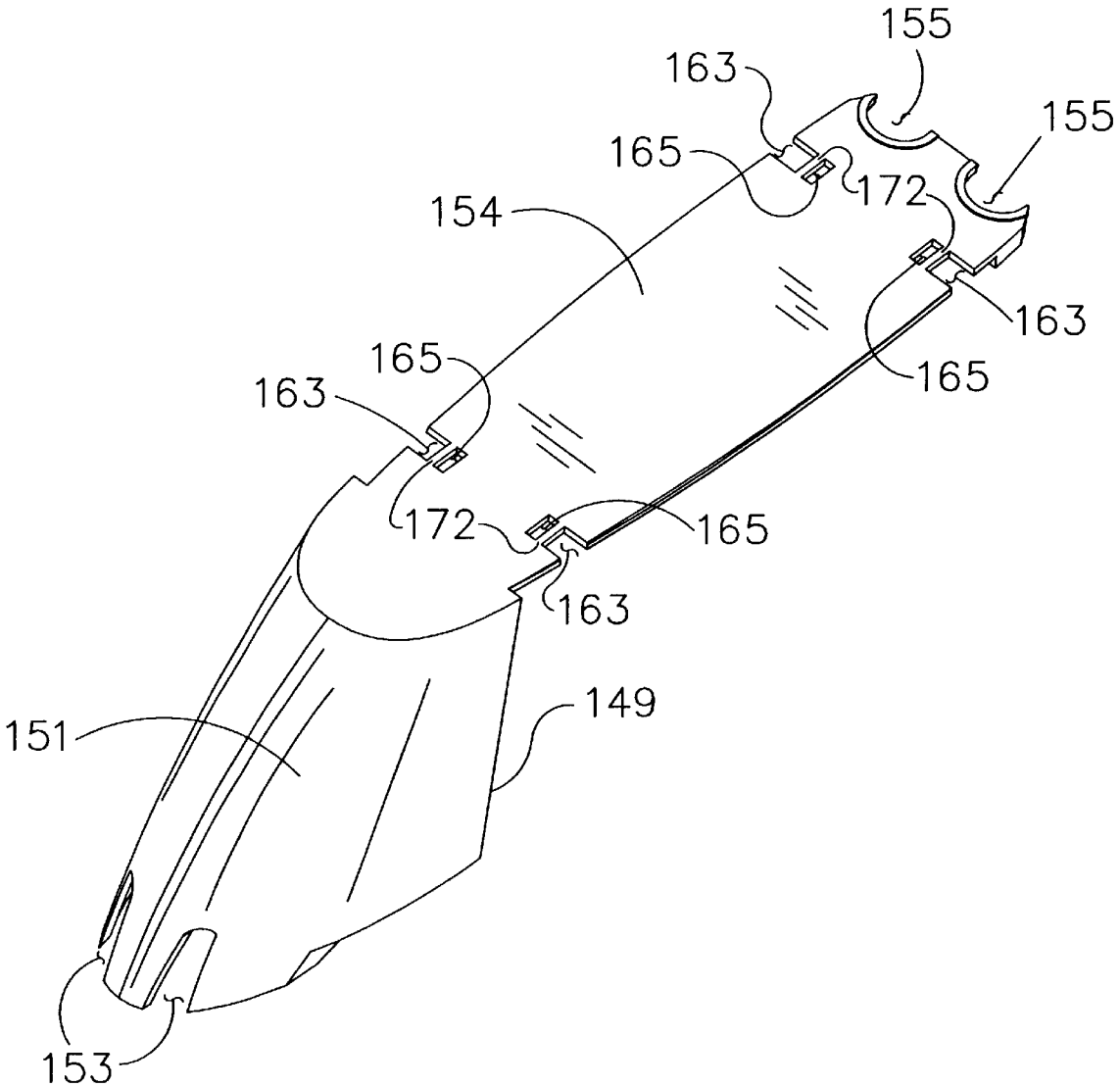
FIG. 8 is an enlarged perspective of a spider shroud.

The spider 117 includes a pair of arms 135 (front), 137 (rear) each with one of the pads 129. The spider 117 includes a through passage 139 opening into the channel 113. The passage 88 (in base 81), channel 113 (in riser 87) and passage 139 form a continuous passage through the pedestal 39 from top to bottom through which cable can pass between the cable trough 45 and the bottom of the pedestal through a passage 88 or alternately through a notch 115. A plurality of ribs 141 (only one is shown) are provided to increase the strength of the spider. The spider 117 also includes a shroud 149 (FIG. 8) that extends between the rear arm 137 to a position forward (toward the front of the table) of the passage 139. The shroud 149 and rear arm 137 form a passage 150 extending between opposite sides of the spider 131 and forms a continuation of the interior of the trough 45 for the stringing of cable(s) between adjacent tables. The shroud 149 includes a nose 151 with grooves 153 received over the ribs 141 and a bridge 154 extending between the nose and the arm 137. Each recess of a pair of recesses 155 in the bridge receives an ear 157 of the rear arm 137 to assist in retaining the shroud on the arm 137. The shroud 149 is secured to the arm by engagement of the ribs 141 in the grooves 153 and engagement of the top of the bridge 154 with the underside 47 of the table top 23. A pair of opposed sets of notches 163 each with an adjacent opening 165 are provided in the bridge 154. The spider 117 including the shroud 149 may be made of a metal such as aluminum alloy by die casting and may be anodized or powder coated for decoration. The spiders 117, bases 81 and risers 87 are symmetrical and may be used on either end of a table to improve manufacturing efficiency.

Figure 9:
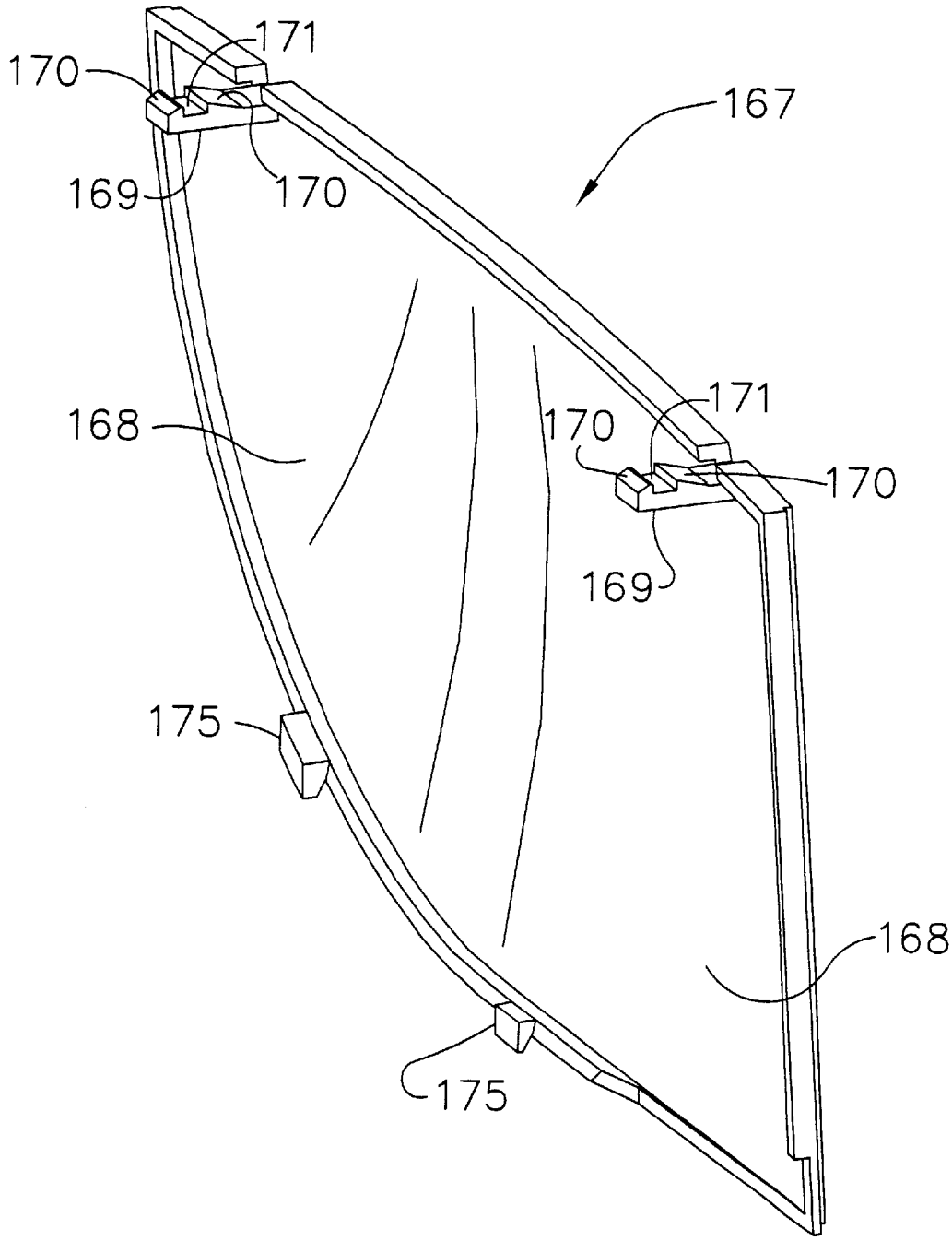
FIG. 9 is an enlarged perspective of a spider cover.

A cover 167 comprising a faceplate 168 is provided to selectively close the outer end of the passage 150 between the shroud 149 and the arm 137 (FIGS. 2 and 9). The cover 167 is provided with a pair of resiliently deformable catches 169 each with a pair of upstanding ears 170 forming a notch 171 therebetween that go through the openings 165 and engage opposite edges of a respective member 172 for retaining the cover on the bridge. The cover 167 is also provided with tabs 175 extending from the face plate 168 and are engageable with the spider 117 in a groove 177 for retaining the cover on the spider. The cover 167 may be made of molded plastic or die cast metal, such as aluminum alloy, (if die cast, it may be anodized or powder coated for decoration).

Figure 16:
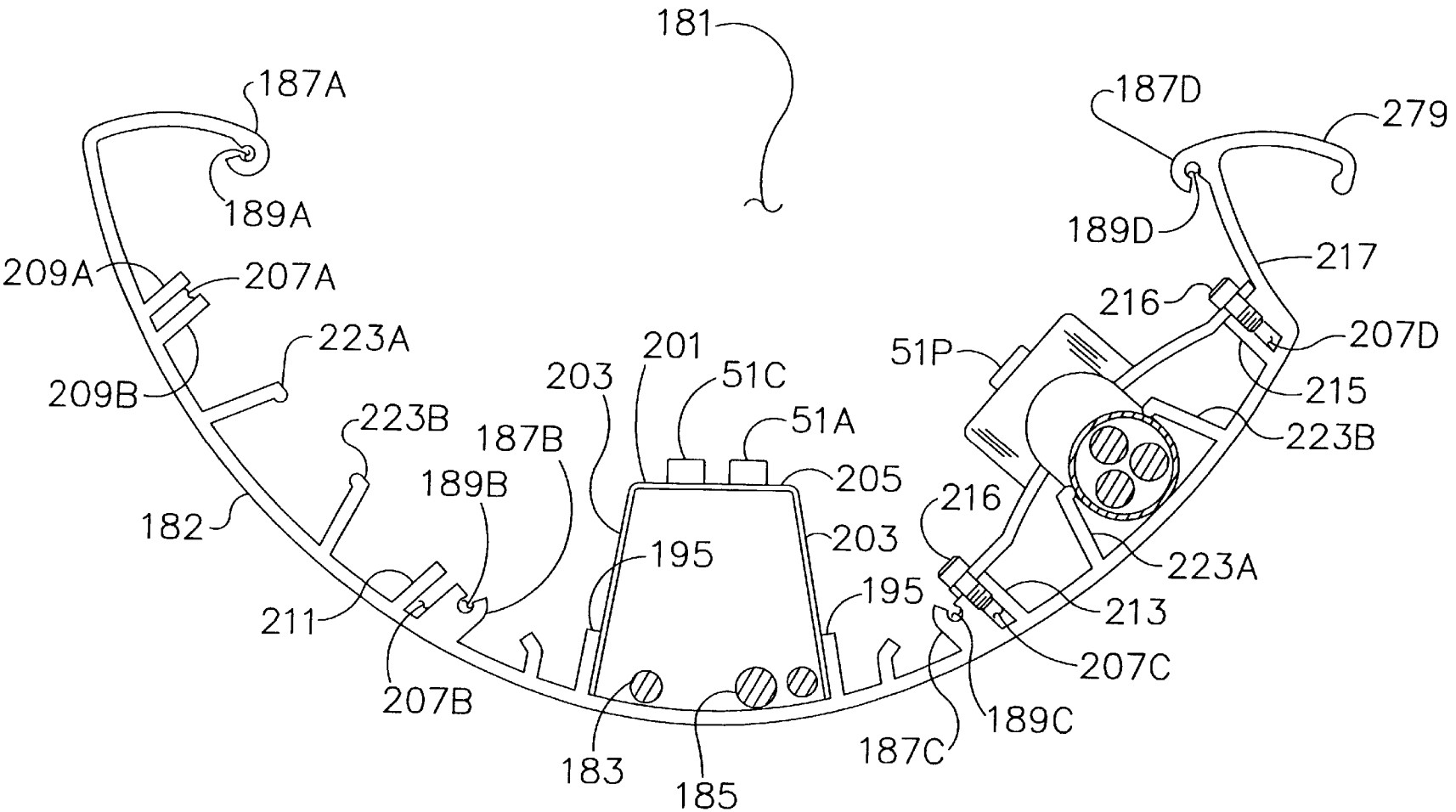
FIG. 16 is an end view of a cable trough with cables mounted therein.
Figure 17:
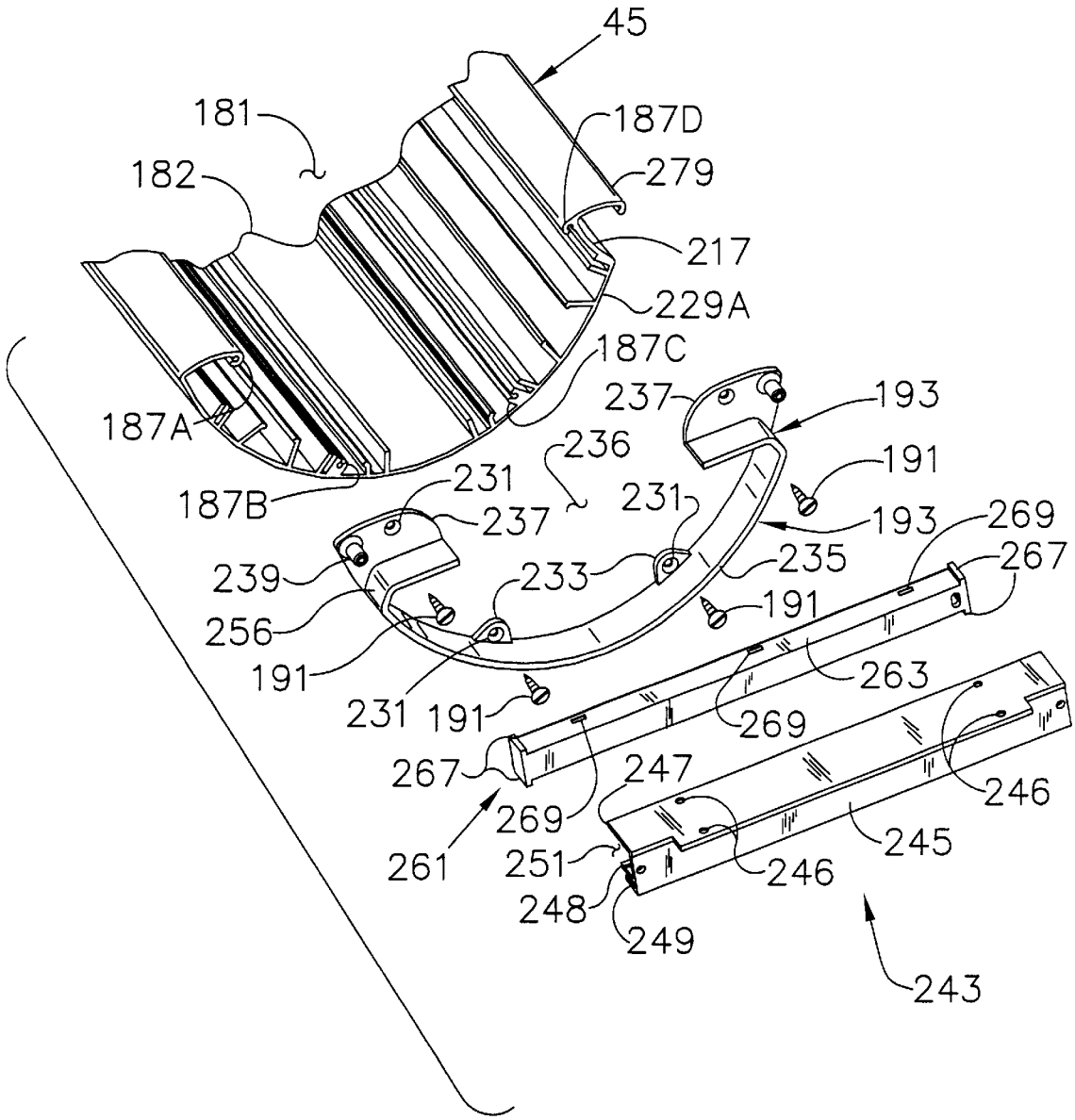
FIG. 17 is an exploded perspective of a cable trough and slide mount.
Figure 18:
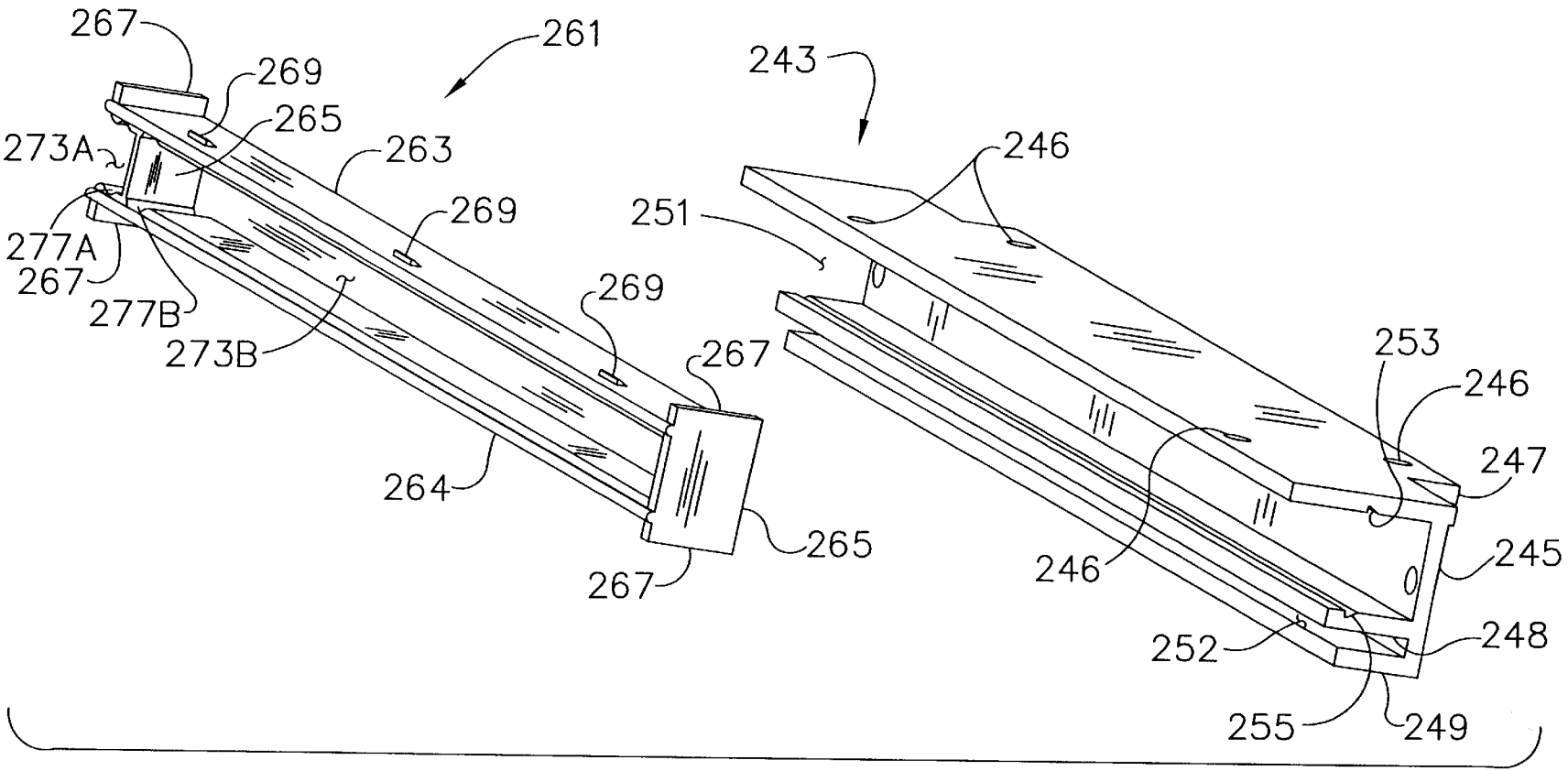
FIG. 18 is an exploded perspective of a cable trough slide mount.

The cable trough 45, FIGS. 5, 10, 16, 17 and 18, is movably mounted on the underside 47 of the table top 23 to selectively provide access to its interior 181. The trough has a curved wall 182 with a series of inwardly projecting ribs (described below) for the stringing and retainment of power cable 103 and other cables such as communication cable 183 (e.g., phone and modem) and computer cable 185 (e.g., networking cable). It is preferred to extrude the trough 45 whereby it has a substantially uniform transverse cross section along its length. The trough is preferably a metal alloy such as aluminum alloy and may be anodized or powder coated for decoration. Referring to FIG. 16, a plurality of longitudinally extending ribs 187A–D are provided, each having an open sided slot 189A–D respectively. The open sides facilitate manufacture of the trough by extrusion. The slots 189A–D are for receiving screw fasteners 191 to mount pivot brackets 193 (hereinafter described). A pair of spaced ribs 195 project from the inner surface 197 of the trough and form a longitudinally extending channel 199. Cables, such as communication and/or network cables 183, 185 respectively, reside in the channel 199. An elongate shielding cover 201 with spaced legs 203 and an intermediate wall 205 is secured to the trough by an interference fit between the legs 203 and the ribs 195. The cover 201 encloses and shields the cables therein. A cover (not shown) like the cover 201 may also be provided in a riser 87 if desired by the provision of ribs on the web 92 like the ribs 195. Receptacles 51A, 51C can be secured to the cover 201 as with snap lock connectors or mechanical fasteners as is known. Longitudinally extending grooves 207A–D are formed by longitudinally extending pairs of ribs 209A, 209B; 211, 187B; 187C, 213; and rib 215 and wall 217. The grooves 207A–D are adapted to mount receptacle 51P with screws 216. The use of grooves allows for precise positioning of a receptacle at any position along the trough 45. Two pairs of longitudinally extending ribs 223A, 223B extend from an interior surface of the trough and define open sided channels 227 therebetween. The ribs 223A, 223B of each pair converge toward their free ends whereby the opening is narrower than the base of the channel to form a snap lock for retaining the power cable 103 therein.

When mounted on the table top and in its closed position, the trough 45 is upwardly opening and substantially or completely covered by the table top 23 (except for the grommet opening 73). A pivot bracket 193 (FIG. 17) is secured to each of the opposite ends 229A, 229B of the trough 45 with the screw fasteners 191 extending through countersunk apertures 231 in integral ears 233 of an arcuate band 235 and threaded into the bores 189A–D. The bracket 193 may be die cast of metal alloy such as aluminum alloy which may be anodized or powder coated. The brackets 193 are generally C-shaped corresponding generally to the transverse cross sectional shape of the trough 45 forming an opening (open end) 236 for cable passage. Bracket 193 also includes a pair of ears 237, one at each end of the band 235, with each ear 237 having a laterally outwardly projecting pin 239. The pins 239 each have a longitudinal axis generally parallel to the longitudinal axis of the trough 45.

Figure 10:
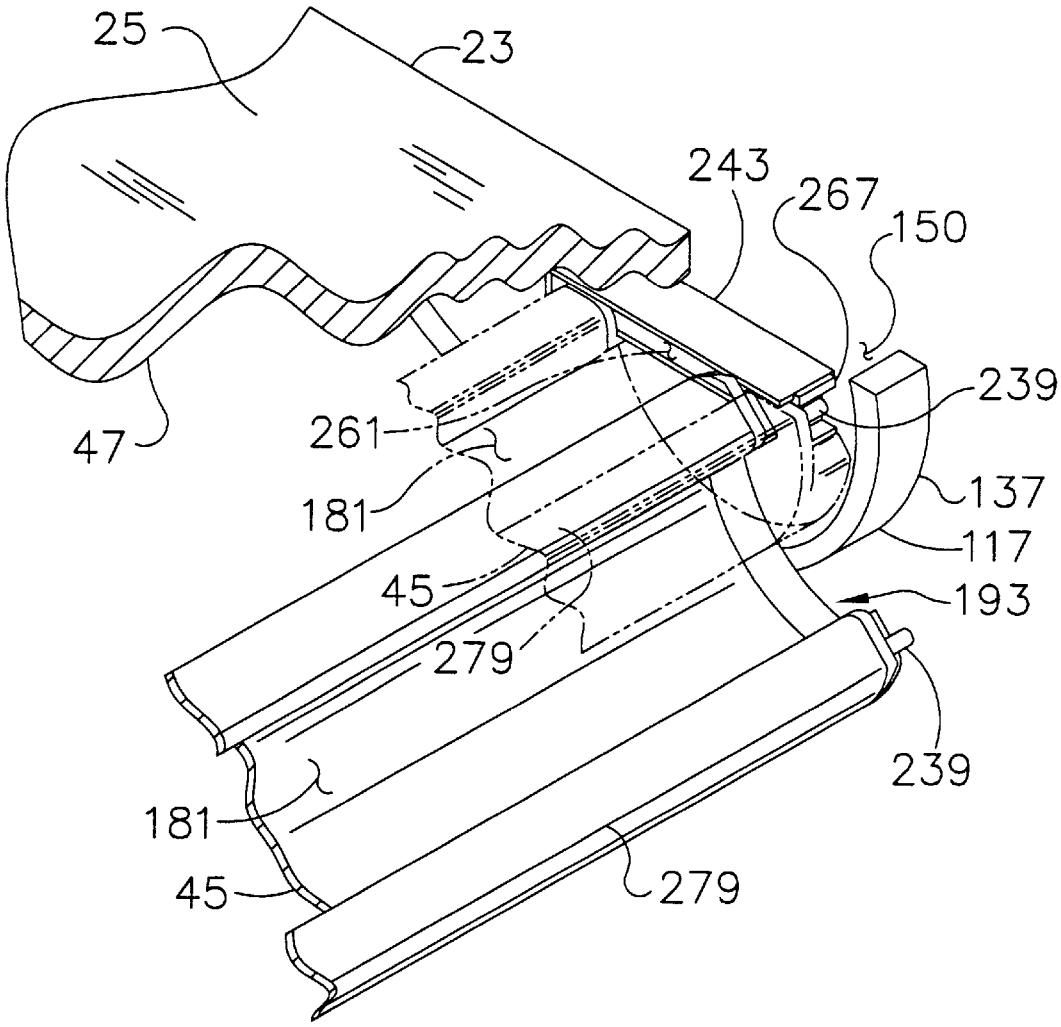
FIG. 10 is a schematic perspective of a cable trough and spider showing the trough open and also in a closed position in phantom.

The trough 45 is movably mounted on the underside 47 of the table top 23 for selectively providing access to the interior of the trough where the cables are located (FIG. 10). When the trough 45 is closed, the openings 236 are each generally in line with a respective passage 150 of the adjacent spider. When open, the trough interior opens generally rearwardly and is exposed for installation of cable and access to installed cables and the receptacles. The cables 103, 183, 185 have sufficient slack to permit opening of the trough. A pair of slide support frames 243 (FIGS. 17 and 18) are secured to the underside 47 of the table top 23 as with screw fasteners 244 through countersunk apertures 246. The frames 243 are each positioned inboard of and immediately adjacent a respective pedestal 39 and extend in a direction from front to rear of the table top 23. A frame 243 includes a generally vertical web 245 with generally perpendicular and horizontal flanges 247, 248, 249 integral therewith and projecting therefrom. The top flange 247 projects from both sides of the web 245. The flanges 247–249 form two channels 251, 252. The flanges 247, 248 form the channel 251 and each has a groove 253, 255 respectively extending along the lengths thereof and opening into the channel 251 and toward one another. The frame 243 may be of extruded metal, such as aluminum alloy, providing a substantially uniform transverse cross sectional shape along its length. The lower flange 249 acts as a stop to limit downward pivoting movement of the trough by engagement with a surface 256 of the bracket 193 (FIG. 10).

A slide rail 261 is provided for fixed mounting in each frame 243 (FIG. 18) to form a trough slide arrangement. A rail 261 includes a pair of spaced and generally parallel upper and lower members 263, 264 joined together adjacent opposite ends by webs 265 that extend between the inside surfaces of the members 263, 264. Stops 267 project outwardly from the outer surfaces of the members 263, 264 and are engageable with opposite ends of the frame 243 to thereby prevent longitudinal movement of the rail 261 in the frame 243. Ribs 269 project outwardly from the outer surfaces of the members 263, 264 and are engageable in the grooves 253, 255 to retain the rail 261 mounted in the frame 243. Longitudinally extending (relative to the table top) slots 273A, 273B are defined by the inner surfaces of the members 263, 264 and are separated by a web 265 extending between the members. The pins 239 are received in the slots 273A, 273B for moveably mounting the trough 45 on the underside of table top 23. In the retracted or concealed position, the rearmost pin 239 rests in a recess 277A while the front most pin rests on the member 264 (both positions being relative to the table front). To move the trough rearward to its extended rearward position, an operator grips the downwardly turned lip 279 (which functions as a handle) of the trough 45, lifts the rear pins 239 from the recesses 277A, pulls the trough rearward until the front pins 239 rest in the recesses 277B allowing the trough to pivot downwardly to expose its interior and cables therein or for stringing cables during setup, making repairs or adding new cables. When in the closed position, the receptacles 51A, 5IC, 51P are in registry with the opening 73 in the grommet 53 to allow plugging in of equipment as needed (FIG. 3).

Figure 19:
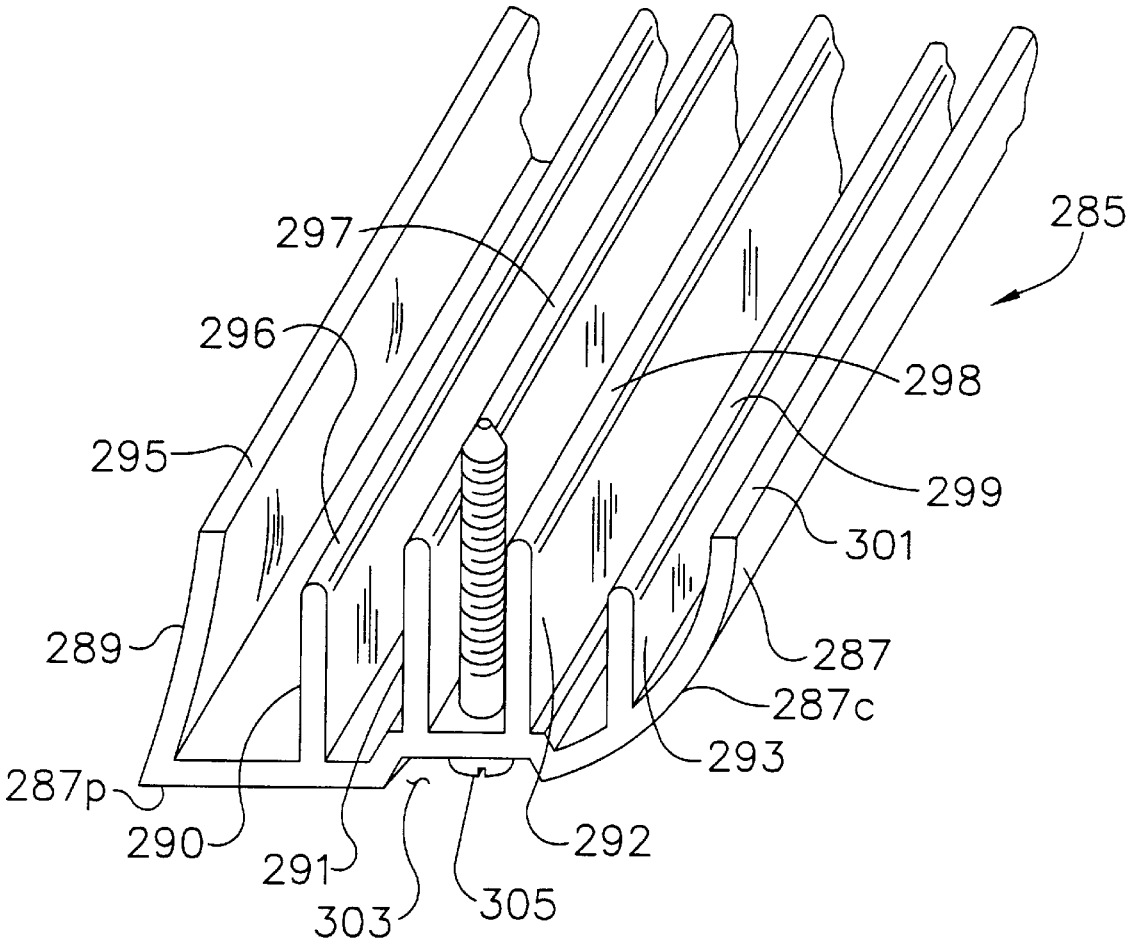
FIG. 19 is a fragmentary perspective of a table top reinforcing strut.

A reinforcing strut 285 is secured to the table top 23 on the underside 47 extending longitudinally between the end edges 31, 33 (FIGS. 5 and 19). The strut is positioned between the front edge 27 and the trough 45 and preferably generally centrally between the front and rear edges 27, 29. The strut 285 may be an extrusion formed metal alloy member (e.g., aluminum alloy) having a substantially uniform transverse cross section along its length. The strut includes a web 287 with a planar section 287P and a curved section 287C and has a plurality of upstanding longitudinally extending reinforcing ribs 289–293 each having a free edge 295–299 respectively. The web 287 also has a free edge 301 of the curved section 287C. The edges 295, 301 lie generally in a first plane when the strut 285 is in a relaxed condition while the edges 297, 298 lie in a second plane slightly below the first plane, e.g., about 0.020" to about 0.040". An elongate longitudinally extending groove 303 is recessed in the bottom face of the web and opens downwardly. A plurality of through apertures (not shown) extend through the planar section 287P at the groove 303 for screw fasteners 305 to secure the strut 285 to the underside 47 of the table top 23. When the fasteners 305 are tightened, the strut is deformed to a degree that the edges 297, 298 will, like the edges 295, 301, engage the underside 47 of the table top thus insuring contact by the edges with the underside. The edges 296, 299 need not engage the engage the table top to assist the other ribs resist deflection under load. The use of the strut 285 allows for the use of a thinner table top and also the placement of the pedestals immediately adjacent the end edges of the table top for support of cables strung between tables.

As seen in FIG. 1, adjacent tables can be joined in end-to-end relation at various angles of orientation thereby to form different configurations of joined tables. When so joined, cable 103, 183, 185 may be strung between the tables by removing the covers 167 in the spiders 117 and passing the cable from one cable trough 45 through immediately adjacent passages 150 into an adjacent cable trough. Such stringing results in very little exposed cable between the tables.

The tables are joined with a wedge shaped (in plan view) connector 311 (two forms being shown and designated 311A (FIG. 13), 311B (FIG. 12) for distinction and being of similar construction) is provided. Connector 311 releasably retains two or more tables in generally end-to-end relation. The connector 311 connects to the tables at the edges 62, 63 and has two side edges 313L, 313R that fix the angle of the joined tables as hereinafter described. Preferably, the edges 313L, 313R are generally straight and positioned relative to one another with an included angle B therebetween. The angle B is generally equal to X+Y−180° where X equals the included angle between the angled edges 62, 63 when adjacent tables to be joined are in a straight line and Y equals the angle between the longitudinal axes of the tables when at the angle they are to be positioned to one another when joined. The angle B is also equal to the included angle between the edges 62, 63 of adjacent end-to-end tables when the tables are oriented in the position that they are to be connected. The connector 11 includes a top member 315 having the edges 313L, 313R thereon and depending from a top panel (bridge) 317. A skirt 314 also depends from the top panel 317 at the outer edge 316 both being outwardly curved. The side edges 313L, 313R of the top member 315 are part of depending latch elements 347L, 347R. The latch elements are positioned and shaped for interlocking engagement with portions of attachment brackets 371L, 371R of the connector 311. The brackets are described below.

Figure 12:
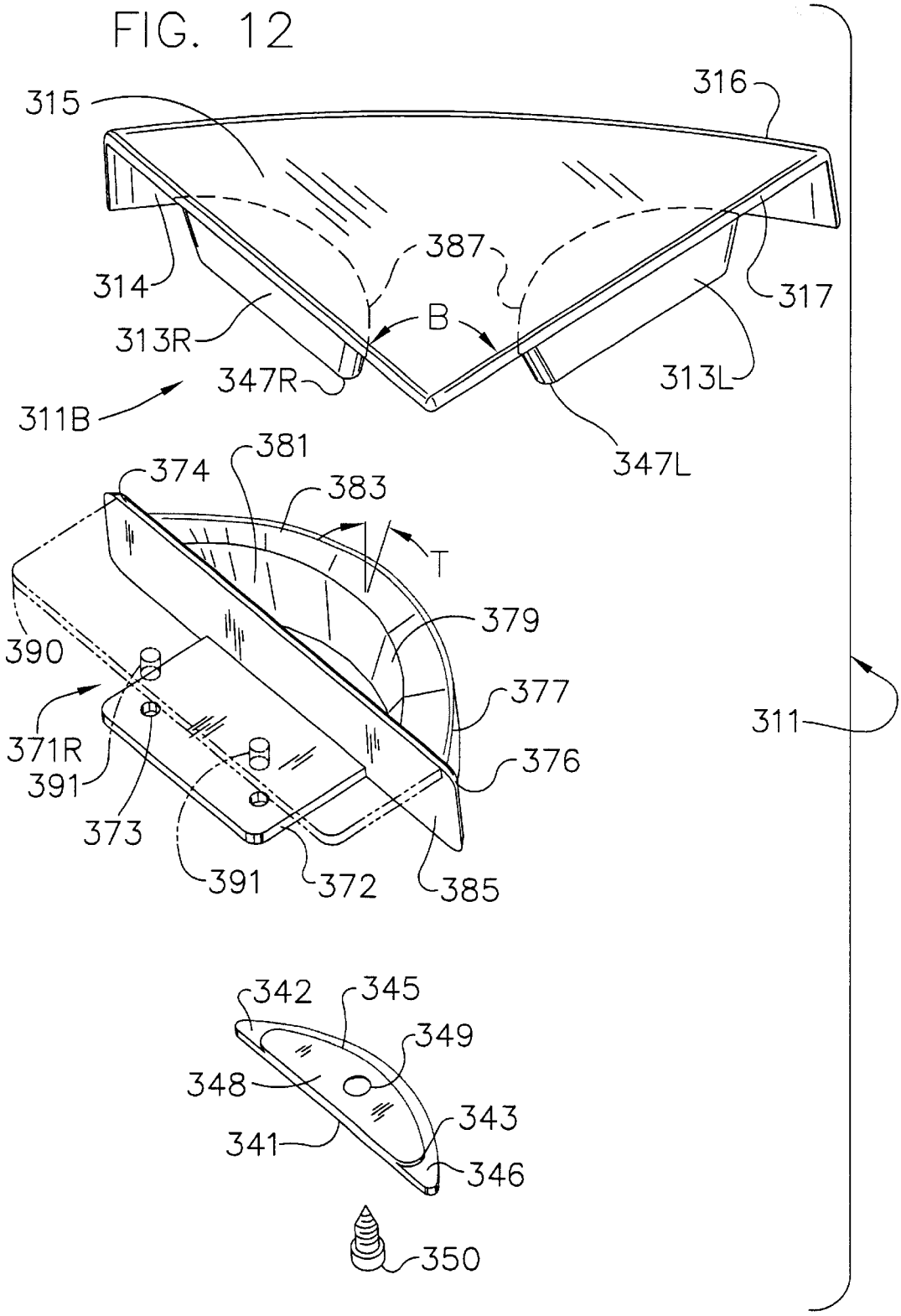
FIG. 12 is an exploded perspective view of a connector used to join tables in end-to-end relation.
Figure 13:
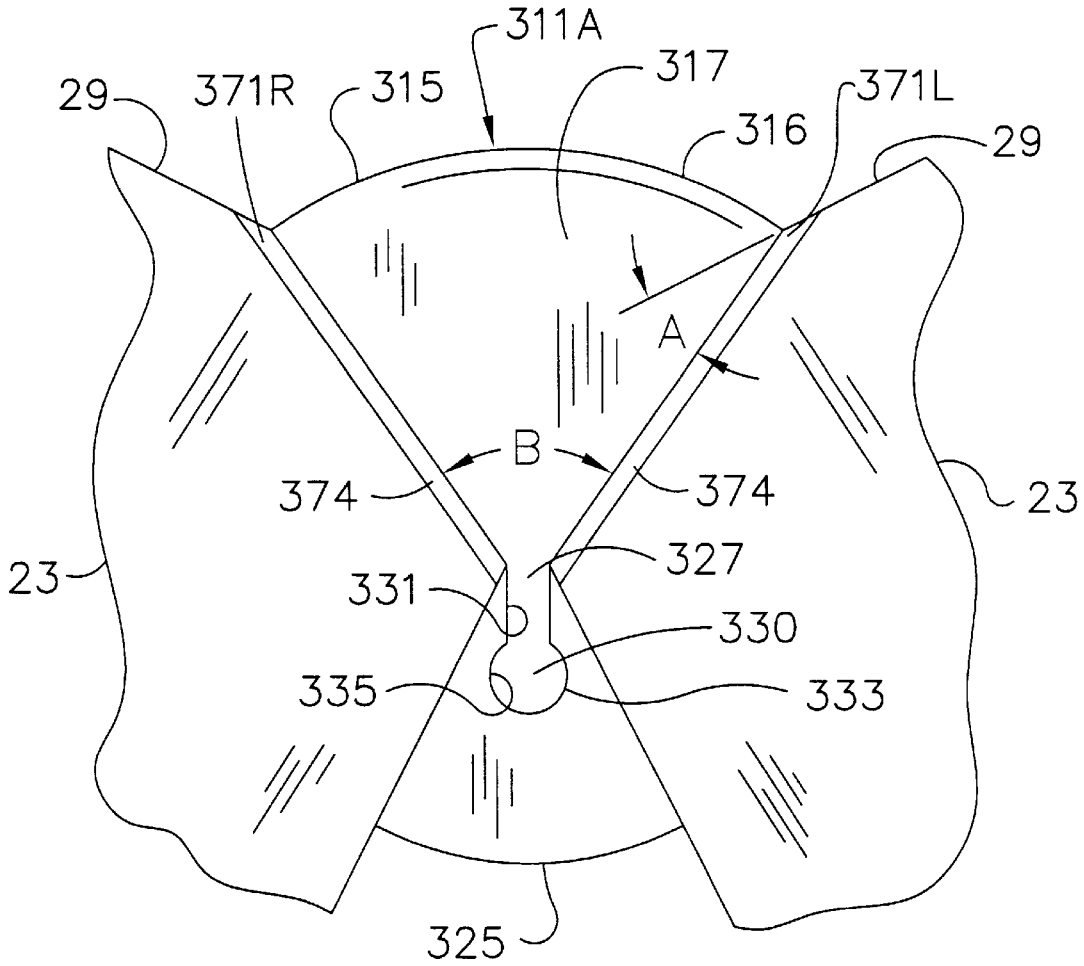
FIG. 13 is a plan view of an alternate connector.

As seen in FIG. 13, the connector 311A further includes a second wedge member 325 extending from the apex 327 of the top panel 317 when the connected tables are positioned at an angle (other than in line) relative to one another. When the connected tables are in line (i.e., their longitudinal axes are generally parallel, i.e., an angle of 180° between their longitudinal axes, the second wedge 325 is not needed, such a connector is denoted 311B (FIG. 12). As shown, the second wedge 325 is a separate part and is joined to the member 315 via a key portion 330 that extends from the apex 327 for receipt in a keyway slot 331 where an enlarged head 333 fits in a bore portion 335 of the slot 331 to help prevent separation. Friction fit secures the second web 325 to the member 315. The wedge 325 is preferably made of a resiliently deformable material such as an elastomer to resiliently resist movement between the adjacent tables when joined together.

Lock clamps 341 are provided for the connector 311 to secure portions of attachment brackets 371L, 371R between the lock clamps 341 and the top member 315. The lock clamps in combination with the top member 315 secure the attachment brackets to the top member 315 and join two tables together. As seen in FIG. 12, a lock clamp 341 is in the form of a plate having a reduced thickness section 342 forming an outer perimeter 343, a shoulder 345 upstanding from the upwardly facing surface 346 and forming a top section 348. A through aperture 349 is provided for receipt of a mechanical fastener 350 such as a socket head screw therethrough to secure the lock clamp to the top member 315 by threaded engagement in threaded bores (not shown).

Attachment brackets 371L, 371R are secured to the table at the edges 62, 63 and have portions that extend outboard thereof to effect attachment of a pair of tables to each other with the connector 311 (A or B) (FIGS. 2 and 12). The brackets are the same and the description of one will suffice for the other. The bracket includes a laterally extending and generally horizontal mounting plate 372 with generally vertical countersunk apertures 373 for fasteners 375 such as flat head screws which secure the bracket to the underside 47 of the table top 23. The plate 372 may be recessed in the underside 47 to provide a flush fit. A generally vertical flange 374 is generally normal to the plate 372 and engages angled edge 62 or 63 of the table top. The height of the flange 374 is such that its upper edge 376 is flush with the work surface (top) 25 of the table top 23 when the bracket is secured to the table top. A striker wall 377 has an arcuate (concave) inside surface 379 spaced from the flange 374 forming a latch opening 381 with a generally vertical longitudinal axis. The surface 379 is downwardly and inwardly tapered from the top 383 to form a taper lock later described. The wall 377 and flange 374 form a receiver for a respective one of the latch elements 347L or 347R. The openings 381 are each adapted to receive therein a latch element 347L or 347R depending from the panel 317 of the top member 315 also having generally vertical longitudinal axes. While one latch element 347 and one receiver are shown at each table end for connection, it is to be understood that multiple latch elements and receivers can be provided at each table end.

The surfaces 313L, 313R engage a generally vertical outwardly facing surface 385 of a respective flange 374 to position the connector 311 relative to the table top and adjacent tables relative to one another. The latch elements 347L, 347R each have an arcuate surface 387 corresponding in shape and taper to that of the surface 379 so that when a latch element is positioned in a respective opening 381, a taper lock is formed between the engaged surfaces 379 and 387. The angle of taper T is in the range of between about 5° through about 15° and is preferably sufficiently large to prevent the formation of a self locking taper fit. The engagement of the latch element 347L, 347R with the walls 377 and flanges 374 interlock adjacent tables and fix the angle of their orientation. The structures of the top member 315, lock clamp 341 and the brackets 371 permit assembly of the connector by simple vertical movement of the members 315, 341 into interlocking engagement with the brackets 371.

With the top member 315 in position and the latch elements 347L, 347R in the openings 381 of adjacent tables, the lock clamps 341 are secured in place. The top sections 348 of the lock clamps 341 extend into lower portions of the openings 381 with the shoulders 345 being shaped generally the same as the openings 381. The engagement of the shoulder 345 with the inside surface of the wall 377 positions the opening 349 in line with the threaded bore in a latch element 347 for receipt of a fastener 350 in a threaded bore. Tightening of the fastener 350 secures the lock clamp 341 to the top member with the wall 377 therebetween. The combined height of a latch element 347 and a top section 348 is preferably less than the height of a wall 377. The walls 377, and thus the brackets 371, are securely clamped between the top and bottom members 315, 341 in a simple and effective manner.

An alternate embodiment of bracket 371 is illustrated in FIG. 12. The additional elements are shown in phantom. A top flange 390 projects laterally from the flange 374 and is spaced from and generally parallel to the plate 372 forming a channel 391 therebetween. The table top 23 is received in the channel 391 with the flange 390 overlying the work surface 27. The table top is thus sandwiched between the flange 390 and plate 372. Mechanical fasteners 375 (which in this embodiment can be self tapping metal screws) are used to secure the bracket 371 to the table top 23 by engagement in bores in the posts 391. Reinforcing bushings (not shown) may be provided in the bores (not shown) through the table top 23. If desired, the top flange 390 may be recessed in the work surface 25.

Figure 14:
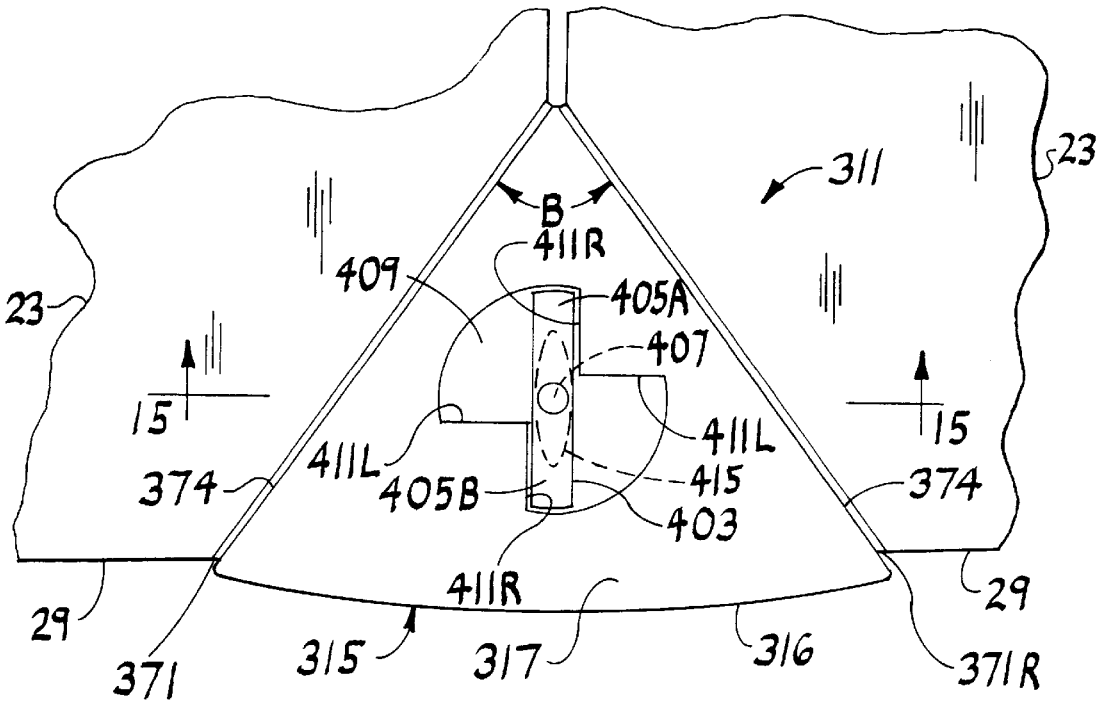
FIG. 14 is a plan view of an additional alternate connector top member showing some parts with hidden parts with broken lines.
Figure 15:
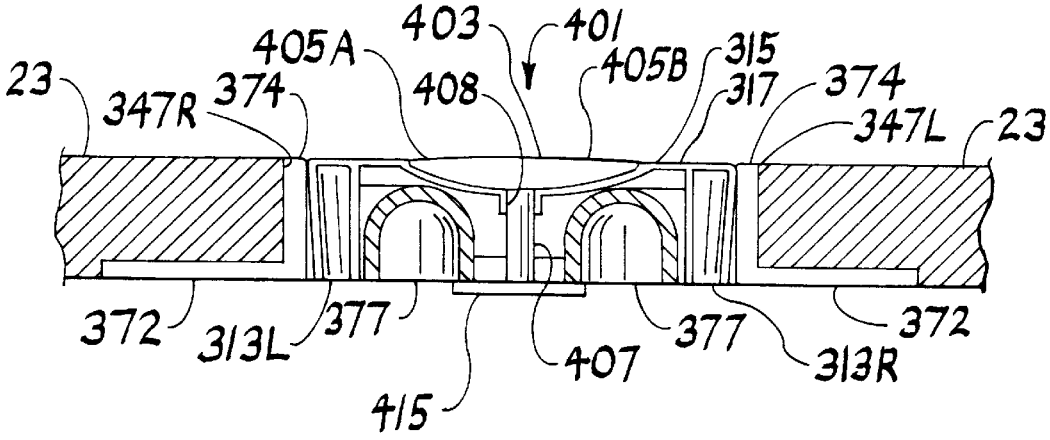
FIG. 15 is a section view of the connector taken along the line 15—15 in FIG. 14 and also showing the other parts of the connector.

An alternate embodiment of the connector 311 is illustrated in FIGS. 14 and 15. In this embodiment a different form of securement device is shown. A rotatable lock device designated generally 401 is shown mounted on the top member 315. The lock device includes a top mounted handle 403 preferably with two wings 405A, 405B projecting from a shaft 407 rotatably mounted in a bore 408. The handle 403 is rotatable in a generally horizontal plane and the shaft 407 has a generally vertical longitudinal axis. The handle 403 may be recessed in a pocket 409. In a preferred embodiment, the pocket includes generally wedge shaped pocket portions each defined by two side surfaces 411L, 411R and a connecting intermediate surface 411C. Each pocket is sized and arranged to receive a respective wing 405A or 405B therein with the surfaces 411L, 411R limiting the amount of rotation of the handle 403 and shaft 407. A lock element 415 is secured to the lower end of the shaft 407 and is rotatable therewith when the handle 403 is turned. The lock element 415 is an elongate bar on the underside of the connector 311 that is movable in a generally horizontal plane. The lock element 415 has opposite ends each selectively movable to a position under a wall 377 of a respective latch element 347L, 347R. When the lock element 415 is under the walls 377, the walls are captured and retained between the latch element and the underside of the bridge to releasably retain the tables in end-to-end relation.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A table for supporting electrically powered equipment for use by persons seated at the table, said table comprising:

a table top having front and rear edges, opposite end edges and having a top surface and an underside;

a support holding said table top in spaced relation above a floor; and a cable trough with an elongate open top providing access to an interior of the trough, said trough being mounted for movement relative to the table top between a closed position in which the open top is disposed adjacent to the underside of the table top so that said open top is substantially covered by the table top and an open position in which the open top is spaced further away from the underside of the table top so that the open top is at least partially uncovered from the table top and said interior is accessible through said open top, said open top having the same dimensions in the open position and the closed position.

2. A table for supporting electrically powered equipment for use by persons seated at the table, said table comprising:

a table top having front and rear edges, opposite end edges and having a top surface and an underside;

a support for holding said table top in spaced relation above a floor; and a cable trough with an elongate open top providing access to an interior of the trough said trough being mounted for movement relative to the table top between a closed position and an open position in which the open top is accessible through said open top;

an opening through said table top and communicating with the interior providing access thereto when said trough is in its closed position, said table top inhibiting access to the remainder of the interior through the open top when said trough is in its closed position; and a receptacle connected to a cable, said receptacle being mounted in said trough and being in registry with said opening in the table top when the trough is in its closed position and said receptacle and cable being accessible when said trough is in its open position.

3. A table as set forth in claim 2 wherein said opening in the table top is positioned rearward of a longitudinal centerline of said top.

4. A table as set forth in claim 3 further including a grommet mounted in said opening in the table top and substantially closing said opening, said grommet having an opening therethrough for the passage of at least one cable through the grommet and the opening in the table top.

5. A table as set forth in claim 1 wherein the trough is disposed in the open position for access to the interior through the open top from a location adjacent to the rear edge of the table top.

6. A table as set forth in claim 5 wherein said trough is pivotally mounted on the table for movement between its open and closed positions.

7. A table as set forth in claim 6 wherein the open top of the trough faces generally rearwardly when in the open position and generally upwardly in the closed position.

8. A table as set forth in claim 7 wherein said trough is mounted on the underside of the table top.

9. A table for supporting electrically powered equipment for use by persons seated at the table, said table comprising:

a table top having front and rear edges, opposite end edges and having a top surface and an underside;

a pedestal positioned adjacent each end edge between the front and rear edges, said pedestals being in supporting relation to said table top; and a cable trough with an elongate open top providing access to an interior of the trough said trough being mounted for movement relative to the table top between a closed position and an open position in which the open top is accessible through said open top;

the trough having at least one open end for passage of cable, one of said pedestals being adjacent the open end and having an upper portion with a passage extending between opposite sides thereof, said upper portion passage being generally in line with said open end when the trough is in its closed position.

10. A table as set forth in claim 9 wherein the trough further comprises another open end and wherein the other said pedestal upper portion has a passage therein generally in line with the other said open end when the trough is in its closed position.

11. A table as set forth in claim 10 wherein said pedestals each include a base connected to a spider by a riser, said riser having an interior passage for cable to pass through.

12. A table as set forth in claim 11 wherein said riser comprises a channel member with a longitudinal open side and a longitudinal interior passage with the open side providing access to the riser interior passage, said riser interior passage being a portion of said pedestal passage, said riser further comprising an elongate panel releasably mounted on said channel member to selectively substantially close said channel member open side.

13. A table as set forth in claim 11 wherein said spider has an opening communicating with the riser interior passage for cable to extend through into the riser interior passage with said opening being part of the pedestal passage, said spider further including a rear arm portion and a shroud with an upper portion passage being between a portion of said shroud and a portion of said rear arm and communicating with the spider opening.

14. A table as set forth in claim 11 in combination with a connector to connect a plurality of tables generally in end-to-end relation.

15. A table as set forth in claim 10 wherein the interior of the trough and the upper portion passage form a generally continuous cable passage when the trough is in the closed position, said cable passage extending substantially the entire length of the table top between the opposite end edges.

16. A table as set forth in claim 10 wherein said pedestals are each attached to the table top at a respective end edge of the table top with the trough extending therebetween, and further including a reinforcing member secured to the underside of the table top and extending between the pedestals to reduce deflection of the table top when loaded.

17. A table as set forth in claim 16 wherein said reinforcing member includes a plurality of longitudinally extending and generally vertical ribs extending upwardly from a web, at least some of said ribs having a free top edge engaging the underside of the table top and further including fasteners securing the reinforcing member to the table top.

18. A table system including a table adapted for being selectively joined to at least one other table at a selected angular relationship, said table comprising:

a table top for each table, each table top having front and rear edges, opposite end edges, a top surface and an underside, said table top having an intermediate edge portion extending between each end edge and one of the front and rear edges at an angle to the end edge, front edge and rear edge, the intermediate edge portions of adjacent joined tables defining a notch, said intermediate edges are generally straight;

a first connector element associated with said table top at at least one intermediate edge of each table;

a second connector element adapted to interengage with the first connector elements of adjacent tables to releasably join two table tops together adjacent one of the end edges of each top at a preselected angular relationship, said first connector element having at least one of a latch element and a receiver for receiving at least one latch element, and said second connector element including a bridge and at least one of the other of the latch element and the receiver, said latch element and said receiver extending generally vertically when the first and second connector elements are connected, said second connector element being generally wedge shaped with two side edges that are generally straight and positioned relative to one another with an included angle therebetween generally equal to the included angle between the intermediate edge portions of adjacent tables to be joined to each other, said side edges and intermediate edges cooperating to fix the angle between two joined tables.

19. A table system as set forth in claim 18 wherein the second connector element has side edge portions each positioned adjacent a respective one of the intermediate edge portions to fix the angle of adjacent tables relative to one another.

20. A table system as set forth in claim 18 wherein said first connector element includes the receiver located outboard of the intermediate edge, the receiver comprising a receiver element and said second connector element includes the latch element comprising a pair of depending latch elements each receivable in a respective one of said receiver elements.

21. A table system as set forth in claim 20 wherein said second connector element includes a retainer sized and arranged to releasably retain a respective one of said latch elements in the corresponding receiver element.

22. A table system including a table adapted for being selectively joined to at least one other table at a selected angular relationship, said table comprising:

a table top for each table, each table top having front and rear edges, opposite end edges, a top surface and an underside, said table top having an intermediate edge portion extending between each end edge and one of the front and rear edges at an angle to the end edge, front edge and rear edge, the intermediate edge portions of adjacent joined tables defining a notch;

a first connector element associated with said table top at at least one intermediate edge of each table;

a second connector element adapted to interengage with the first connector elements of adjacent tables to releasably join two table tops together adjacent one of the end edges of each top at a preselected angular relationship;

said first connector element having at least one of a latch element and a receiver for receiving at least one latch element and said second connector element including a bridge and at least one of the other of the latch element and the receiver, said latch element and said receiver extending generally vertically when the first and second connector elements are connected;

said first connector element including the receiver located outboard of the intermediate edge, the receiver comprising a receiver element and said second connector element includes the latch element comprising a pair of depending latch elements each receivable in a respective one of said receiver elements;

said second connector element including a retainer sized and arranged to releasably retain a respective one of said latch elements in the corresponding receiver element:

each receiver element defined on an outboard side thereof by a wall with an inward facing surface, each latch element having a mating surface facing oppositely of the inward facing surface and engageable therewith.

23. A table system as set forth in claim 22 wherein said inward facing surface of each receiver element is concave with respect to the adjacent intermediate edge of the table top.

24. A table system including a table adapted for being selectively joined to at least one other table at a selected angular relationship, said table comprising:

a table top for each table, each table top having front and rear edges, opposite end edges, a top surface and an underside, said table top having an intermediate edge portion extending between each end edge and one of the front and rear edges at an angle to the end edge, front edge and rear edge, the intermediate edge portions of adjacent joined tables defining a notch;

a first connector element associated with said table top at at least one intermediate edge of each table;

a second connector element adapted to interengage with the first connector elements of adjacent tables to releasably join two table tops together adjacent one of the end edges of each top at a preselected angular relationship;

said first connector element having at least one of a latch element and a receiver for receiving at least one latch element and said second connector element including a bridge and at least one of the other of the latch element and the receiver, said latch element and said receiver extending generally vertically when the first and second connector elements are connected;

said first connector element including the receiver located outboard of the intermediate edge, the receiver comprising a receiver element and said second connector element includes the latch element comprising a pair of depending latch elements each receivable in a respective one of said receiver elements;

said second connector element including a retainer sized and arranged to releasably retain a respective one of said latch elements in the corresponding receiver element;

said second connector element further comprising a device rotatably mounted on said bridge and accessible from the top of the bridge and associated with the retainer whereby rotation of said device effects rotation of said retainer for releasably securing said second connector to at least one said receiver.

25. A connector for use in joining tables in end-to-end relation comprising:

brackets each adapted to be secured to a respective one of the tables adjacent a corner thereof;

a bridge adapted to extend between and releasably join said brackets together, and wherein said brackets each having at least one of a receiver and a latch element with a generally vertical axis, and said bridge having at least one of the other of the receiver or latch element with a generally vertical axis, said at least one of the latch element and receiver of the bracket being receivable in said at least one of the other of the latch element and receiver in the bridge, said bridge comprising a plate including at least a pair of latch elements depending from the plate and each of the brackets includes at least one receiver, each receiver being adapted to receive a respective latch element therein to resist horizontal movement therebetween, wherein each latch element includes an inboard surface with a downwardly and outwardly tapered portion and each receiver has a receiver element having a first surface with a downwardly and inwardly tapered portion engageable with a tapered surface of a respective latch element; and at least one lock element cooperating with the brackets and the bridge to releasably retain said bridge connected to said brackets.

26. A connector as set forth in claim 25 wherein said bridge and brackets have surfaces that engage to fix end-to-end tables at a predetermined angle relative to one another.

27. A connector as set forth in claim 26 wherein said latch elements each have an outboard surface and said brackets each have an outwardly facing surface engageable with a respective latch element outboard surface to fix said tables at the predetermined angle.

28. A connector as set forth in claim 25 wherein said inboard surface and first surface are generally arcuate with said inboard surfaces of the latch elements being convex and said first surfaces of the receiver elements being concave.

29. A connector as set forth in claim 25 in combination with one of the tables.

30. A connector for use in joining tables in end-to-end relation comprising:

brackets each adapted to be secured to a respective one of the tables adjacent a corner thereof;

a bridge adapted to extend between and releasably join said brackets together, and wherein said brackets each having at least one of a receiver and a latch element with a generally vertical axis, and said bridge having at least one of the other of the receiver or latch element with a generally vertical axis, said at least one of the latch element and receiver of the bracket being receivable in said at least one of the other of the latch element and receiver in the bridge; and at least one lock element cooperating with the brackets and the bridge to releasably retain said bridge connected to said brackets;

said bridge comprising a plate including at least a pair of latch elements depending from the plate and each of the brackets includes at least one receiver, each receiver being adapted to receive a respective latch element therein to resist horizontal movement therebetween;

said lock element including a clamp plate removably secured to each of the latch elements wherein a portion of each receiver is clamped between the bridge and a respective clamp plate.

31. A connector for use in joining tables in end-to-end relation comprising:

brackets each adapted to be secured to a respective one of the tables adjacent a corner thereof;

a bridge adapted to extend between and releasably join said brackets together, and wherein said brackets each having at least one of a receiver and a latch element with a generally vertical axis, and said bridge having at least one of the other of the receiver or latch element with a generally vertical axis, said at least one of the latch element and receiver of the bracket being receivable in said at least one of the other of the latch element and receiver in the bridge; and at least one lock element cooperating with the brackets and the bridge to releasably retain said bridge connected to said brackets;

said bridge comprising a plate including at least a pair of latch elements depending from the plate and each of the brackets includes at least one receiver, each receiver being adapted to receive a respective latch element therein to resist horizontal movement therebetween;

said lock element including a clamp plate rotatably mounted on the bridge and adapted to engage a lower surface of each of the receivers to clamp a portion of each of the receivers between the clamp plate and the bridge.

32. A connector as set forth in claim 31 wherein said lock element includes a handle positioned on a top side of the bridge and said latch elements depend from a bottom side of the bridge.

33. A connector as set forth in claim 32 wherein the brackets each include a flange adapted to be secured to an underside of a table top of one of the tables.

34. A connector for use in joining tables in end-to-end relation comprising:

brackets each adapted to be secured to a respective one of the tables adjacent a corner thereof;

a bridge adapted to extend between and releasably join said brackets together, and wherein said brackets each having at least one of a receiver and a latch element with a generally vertical axis, and said bridge having at least one of the other of the receiver or latch element with a generally vertical axis, said at least one of the latch element and receiver of the bracket being receivable in said at least one of the other of the latch element and receiver in the bridge; and at least one lock element cooperating with the brackets and the bridge to releasably retain said bridge connected to said brackets;

said bridge comprising a plate including at least a pair of latch elements depending from the plate and each of the brackets includes at least one receiver, each receiver being adapted to receive a respective latch element therein to resist horizontal movement therebetween, said bridge and brackets having surfaces that engage to fix end-to-end tables at a predetermined angle relative to one another;

said latch elements each having an outboard surface and said brackets each have an outwardly facing surface engageable with a respective latch element outboard surface to fix said tables at the predetermined angle;

said bridge being generally wedge shaped with two side edges with the outboard surface of each latch element being generally parallel with a respective side edge.

35. A connector as set forth in claim 34 wherein each said side edge is vertically above and in line with a respective outboard surface.

36. A table as set forth in claim 1 wherein the cable trough is mounted for translational and pivoting motion relative to the table top.

37. A table as set forth in claim 36 wherein the cable trough is mounted for movement from the closed position to the open position so that the cable trough moves first translationally and then pivotally.

38. A table as set forth in claim 36 further comprising rails mounted at spaced apart locations on the table top, and wherein the cable trough comprises pins slidably engageable with the rails for translational movement of the cable trough relative to the table top.

39. A table as set forth in claim 38 wherein at least some of the pins are free of engagement with the rails in the open position of the cable trough.

* * * * *